US012385112B2

(12) United States Patent
Siles et al.

(10) Patent No.: US 12,385,112 B2
(45) **Date of Patent: *Aug. 12, 2025**

(54) IMPACT EXTRUDED CONTAINERS FROM RECYCLED ALUMINUM SCRAP

(71) Applicant: Ball Corporation, Westminster, CO (US)

(72) Inventors: John L. Siles, Westminster, CO (US); Samuel Melancon, Sherbrooke (CA); Stanley M. Platek, Edgewater, MD (US); Anthony Chatey, Kolin (CZ)

(73) Assignee: BALL CORPORATION, Westminster, CO (US)

( * ) Notice: Subject to any disclaimer, the term of this patent is extended or adjusted under 35 U.S.C. 154(b) by 412 days.

This patent is subject to a terminal disclaimer.

(21) Appl. No.: 16/809,420

(22) Filed: Mar. 4, 2020

(65) Prior Publication Data

US 2020/0199715 A1 Jun. 25, 2020

Related U.S. Application Data

(62) Division of application No. 15/098,654, filed on Apr. 14, 2016, now Pat. No. 10,584,402, which is a (Continued)

(51) Int. Cl.
*C22C 21/08* (2006.01)
*B21C 23/00* (2006.01)
(Continued)

(52) U.S. Cl.
CPC ..... *C22C 21/08* (2013.01); *B21C 23/002* (2013.01); *B21C 23/18* (2013.01); *B22D 21/007* (2013.01);
(Continued)

(58) Field of Classification Search
CPC ..... C22C 21/08
See application file for complete search history.

(56) References Cited

U.S. PATENT DOCUMENTS 3,029,507 A 4/1962 Gaggini
3,232,260 A 2/1966 Siemonsen
(Continued)

FOREIGN PATENT DOCUMENTS

CA 1252649 4/1989
CA 2133312 7/1994
(Continued)

OTHER PUBLICATIONS

Cotell et al., "Surface Engineering of Aluminum and Aluminum Alloys," ASM Handbook, vol. 5: Surface Engineering, 1994, pp. 784-804.

(Continued)

*Primary Examiner* — George Wyszomierski
*Assistant Examiner* — Janell C Morillo
(74) *Attorney, Agent, or Firm* — Sheridan Ross P.C.

(57) ABSTRACT

Novel recycled aluminum alloys are provided for use in an impact extrusion manufacturing process to create shaped containers and other articles of manufacture. In one embodiment blends of recycled scrap aluminum are used in conjunction with relatively pure aluminum to create novel compositions which may be formed and shaped in an environmentally friendly process. Other embodiments include methods for manufacturing a slug material comprising recycled aluminum for use in the impact extraction process.

20 Claims, 8 Drawing Sheets

Related U.S. Application Data division of application No. 13/617,119, filed on Sep. 14, 2012, now Pat. No. 9,663,846.

(60) Provisional application No. 61/535,807, filed on Sep. 16, 2011.

(51) Int. Cl.

| | |
|---|---|
| ***B21C 23/18*** | (2006.01) |
| ***B22D 21/00*** | (2006.01) |
| ***C22C 21/00*** | (2006.01) |
| ***C22C 21/06*** | (2006.01) |
| ***C22F 1/04*** | (2006.01) |
| *B65D 83/38* | (2025.01) |

(52) U.S. Cl.

CPC ..... *C22C 21/00* (2013.01); *C22C 21/06* (2013.01); *C22F 1/04* (2013.01); *B65D 83/38* (2013.01)

(56) References Cited

U.S. PATENT DOCUMENTS

| | | | |
|---|---|---|---|
| 3,787,248 | A | 1/1974 | Setzer et al. |
| 3,812,646 | A | 5/1974 | Baldyga et al. |
| 4,243,438 | A | 1/1981 | Yanagida et al. |
| 4,260,419 | A | 4/1981 | Robertson |
| 4,269,632 | A | 5/1981 | Robertson et al. |
| 4,282,044 | A | 8/1981 | Robertson et al. |
| 4,318,755 | A | 3/1982 | Jeffrey et al. |
| 4,403,493 | A | 9/1983 | Atkinson |
| 4,411,707 | A | 10/1983 | Brennecke et al. |
| 4,693,108 | A | 9/1987 | Traczyk et al. |
| 4,732,027 | A | 3/1988 | Traczyk et al. |
| 5,102,705 | A | 4/1992 | Yammoto et al. |
| 5,104,465 | A | 4/1992 | McAuliffe et al. |
| 5,110,545 | A | 5/1992 | McAuliffe et al. |
| 5,138,858 | A | 8/1992 | Johnson et al. |
| 5,293,765 | A | 3/1994 | Nussbaum-Pogacnik |
| 5,355,710 | A | 10/1994 | Diekhoff |
| 5,362,341 | A | 11/1994 | Palmer et al. |
| 5,394,727 | A | 3/1995 | Diekhoff et al. |
| 5,448,903 | A | 9/1995 | Johnson |
| 5,469,729 | A | 11/1995 | Hager |
| 5,486,243 | A | 1/1996 | Hashiguchi et al. |
| 5,487,295 | A | 1/1996 | Diekhoff et al. |
| 5,503,690 | A | 4/1996 | Wade et al. |
| 5,522,248 | A | 6/1996 | Diekhoff et al. |
| 5,522,950 | A | 6/1996 | Bartges et al. |
| 5,551,997 | A | 9/1996 | Marder et al. |
| 5,571,347 | A | 11/1996 | Bergsma |
| 5,572,893 | A | 11/1996 | Goda et al. |
| 5,704,240 | A | 1/1998 | Jordan |
| 5,713,235 | A | 2/1998 | Diekhoff |
| 5,718,352 | A | 2/1998 | Diekhoff et al. |
| 5,769,331 | A | 6/1998 | Yamagishi et al. |
| 5,772,802 | A | 6/1998 | Sun et al. |
| 5,778,723 | A | 7/1998 | Diekhoff |
| 5,822,843 | A | 10/1998 | Diekhoff et al. |
| 6,010,026 | A | 1/2000 | Diekhoff et al. |
| 6,010,028 | A | 1/2000 | Jordan et al. |
| 6,100,028 | A | 8/2000 | Cole et al. |
| 6,126,034 | A | 10/2000 | Borden et al. |
| 6,171,362 | B1 | 1/2001 | Osumi et al. |
| 6,355,090 | B1 | 3/2002 | Ohyama et al. |
| 6,368,427 | B1 | 4/2002 | Sigworth |
| 6,543,636 | B1 | 4/2003 | Flecheux et al. |
| 6,607,815 | B2 | 8/2003 | Bekki et al. |
| 6,627,012 | B1 | 9/2003 | Tack et al. |
| 6,630,037 | B1 | 10/2003 | Sawada et al. |
| 6,666,933 | B2 | 12/2003 | Roberts et al. |
| 6,676,775 | B2 | 1/2004 | Barth et al. |
| 6,945,085 | B1 | 9/2005 | Goda |
| 6,959,830 | B1 | 11/2005 | Kanou et al. |
| 7,117,704 | B2 | 10/2006 | Ogura et al. |
| 7,140,223 | B2 | 11/2006 | Chupak |
| 7,147,123 | B2 | 12/2006 | Yamashita |
| 7,171,840 | B2 | 2/2007 | Kanou et al. |
| 7,294,213 | B2 | 11/2007 | Warner et al. |
| 7,520,044 | B2 | 4/2009 | Bulliard et al. |
| 7,555,927 | B2 | 7/2009 | Hanafusa et al. |
| 7,588,808 | B2 | 9/2009 | Hutchinson et al. |
| 7,666,267 | B2 | 2/2010 | Benedictus et al. |
| 7,713,363 | B2 | 5/2010 | Sano et al. |
| 7,798,357 | B2 | 9/2010 | Hanafusa et al. |
| 7,824,750 | B2 | 11/2010 | Takegoshi et al. |
| 8,037,728 | B2 | 10/2011 | Hosoi |
| 8,037,734 | B2 | 10/2011 | Hanafusa et al. |
| 8,091,402 | B2 | 1/2012 | Hanafusa et al. |
| 8,132,439 | B2 | 3/2012 | Hanafusa et al. |
| 8,132,687 | B2 | 3/2012 | Fedusa et al. |
| 8,313,003 | B2 | 11/2012 | Riley et al. |
| 8,349,419 | B2 | 1/2013 | Nishida et al. |
| 9,227,748 | B2 | 1/2016 | Nakagawa et al. |
| 9,517,498 | B2 * | 12/2016 | Siles ..... B23P 15/00 |
| 9,844,805 | B2 * | 12/2017 | Siles ..... B23P 15/00 |
| 10,584,402 | B2 * | 3/2020 | Siles ..... B21C 23/002 |
| 2001/0003292 | A1 | 6/2001 | Sun et al. |
| 2001/0031376 | A1 | 10/2001 | Fulton et al. |
| 2002/0000788 | A1 | 1/2002 | Ostergaard et al. |
| 2002/0007881 | A1 | 1/2002 | Daaland et al. |
| 2004/0025981 | A1 | 2/2004 | Tack et al. |
| 2004/0035871 | A1 | 2/2004 | Chupak |
| 2004/0140237 | A1 | 7/2004 | Brownewell |
| 2004/0173560 | A1 | 9/2004 | Chupak |
| 2004/0213695 | A1 | 10/2004 | Ferreira et al. |
| 2005/0067365 | A1 | 3/2005 | Hanafusa et al. |
| 2005/0127077 | A1 | 6/2005 | Chupak |
| 2006/0021415 | A1 | 2/2006 | Bulliard et al. |
| 2007/0062952 | A1 | 3/2007 | Kobayashi et al. |
| 2007/0295051 | A1 | 12/2007 | Myers et al. |
| 2008/0011702 | A1 | 1/2008 | Walsh |
| 2008/0022746 | A1 | 1/2008 | Myers et al. |
| 2008/0041501 | A1 * | 2/2008 | Platek ..... C22C 21/06 148/551 |
| 2008/0163883 | A1 | 7/2008 | Hankey et al. |
| 2008/0181812 | A1 | 7/2008 | Ferreira et al. |
| 2008/0299001 | A1 | 12/2008 | Langlais et al. |
| 2009/0220714 | A1 | 9/2009 | Nishida et al. |
| 2009/0277862 | A1 | 11/2009 | Masuda et al. |
| 2010/0065528 | A1 | 3/2010 | Hanafusa et al. |
| 2010/0199741 | A1 | 8/2010 | Myers et al. |
| 2010/0326946 | A1 | 12/2010 | Hanafusa et al. |
| 2011/0113732 | A1 | 5/2011 | Adams et al. |
| 2012/0024813 | A1 | 2/2012 | Nakagawa et al. |
| 2012/0031913 | A1 | 2/2012 | Moore et al. |
| 2012/0269602 | A1 | 10/2012 | Hanafusa et al. |
| 2013/0068352 | A1 * | 3/2013 | Siles ..... B21C 23/18 148/552 |
| 2013/0202477 | A1 | 8/2013 | Zajac et al. |

FOREIGN PATENT DOCUMENTS

| | | |
|---|---|---|
| CA | 2169743 | 2/1995 |
| CA | 2206483 | 9/1999 |
| CA | 2302557 | 9/2001 |
| CA | 2655925 | 1/2008 |
| CA | 2662199 | 3/2008 |
| CA | 2638403 | 10/2009 |
| CN | 1044925 | 8/1990 |
| CN | 1256671 | 6/2000 |
| CN | 1617821 | 5/2005 |
| CN | 1994826 | 7/2007 |
| CN | 101294255 | 10/2008 |
| CN | 100515875 | 7/2009 |
| CN | 101888907 | 11/2010 |
| CN | 101985707 | 3/2011 |
| DE | 60206036 | 6/2006 |
| EP | 0721384 | 7/1996 |
| EP | 1136154 | 9/2001 |
| EP | 1531952 | 8/2006 |
| EP | 1731239 | 12/2006 |
| EP | 2119515 | 11/2009 |
| EP | 2146907 | 1/2010 |

(56) References Cited

FOREIGN PATENT DOCUMENTS

| | | |
|---|---|---|
| EP | 2531409 | 12/2012 |
| EP | 2646328 | 10/2013 |
| EP | 2955131 | 12/2015 |
| EP | 3141624 | 3/2017 |
| FR | 2457328 | 12/1980 |
| GB | 971258 | 9/1964 |
| GB | 1215648 | 12/1970 |
| GB | 1598428 | 9/1981 |
| JP | S61-163233 | 7/1986 |
| JP | S62-263954 | 11/1987 |
| JP | H04-99142 | 3/1992 |
| JP | H06-279888 | 10/1994 |
| JP | H10-203573 | 8/1998 |
| JP | H11-293363 | 10/1999 |
| JP | 2000-063973 | 2/2000 |
| JP | 2001-115226 | 4/2001 |
| JP | 2001-172728 | 6/2001 |
| JP | 2001-181768 | 7/2001 |
| JP | 2001-213416 | 8/2001 |
| JP | 2001-315745 | 11/2001 |
| JP | 2002-173717 | 6/2002 |
| JP | 3408213 | 5/2003 |
| JP | 2003-205924 | 7/2003 |
| JP | 2003-268460 | 9/2003 |
| JP | 2003-334631 | 11/2003 |
| JP | 2004-035036 | 2/2004 |
| JP | 2004-083128 | 3/2004 |
| JP | 2005-096843 | 4/2005 |
| JP | 2005-511418 | 4/2005 |
| JP | 2005-193272 | 7/2005 |
| JP | 2005-280768 | 10/2005 |
| JP | 2006-62755 | 3/2006 |
| JP | 2006-62756 | 3/2006 |
| JP | 3754076 | 3/2006 |
| JP | 3886329 | 2/2007 |
| JP | 2007-106621 | 4/2007 |
| JP | 2007-153363 | 6/2007 |
| JP | 4159956 | 10/2008 |
| JP | 4173388 | 10/2008 |
| JP | 2009108421 | 5/2009 |
| JP | 2010-202908 | 9/2010 |
| JP | 4564328 | 10/2010 |
| JP | 2011-116456 | 6/2011 |
| JP | 4757022 | 8/2011 |
| JP | 2011-208273 | 10/2011 |
| JP | 2011-526232 | 10/2011 |
| JP | 2012-192984 | 10/2012 |
| JP | 5290569 | 9/2013 |
| JP | 5323757 | 10/2013 |
| JP | 5597333 | 10/2014 |
| JP | 5855233 | 2/2016 |
| JP | 5887340 | 3/2016 |
| RU | 2221891 | 1/2004 |
| UA | 44247 | 2/2002 |
| UA | 29644 | 2/2007 |
| UA | 28415 | 12/2007 |
| WO | WO 92/04477 | 3/1992 |
| WO | WO 93/17864 | 9/1993 |
| WO | WO 96/15865 | 5/1996 |
| WO | WO 96/28582 | 9/1996 |
| WO | WO 97/38146 | 10/1997 |
| WO | WO 97/46726 | 12/1997 |
| WO | WO 98/46488 | 10/1998 |
| WO | WO 99/18250 | 4/1999 |
| WO | WO 99/32363 | 7/1999 |
| WO | WO 99/37826 | 7/1999 |
| WO | WO 00/03933 | 1/2000 |
| WO | WO 2004/094679 | 11/2004 |
| WO | WO 2008/002899 | 1/2008 |
| WO | WO 2008/103629 | 8/2008 |
| WO | WO 2010/117009 | 10/2010 |
| WO | WO 2011/078057 | 6/2011 |
| WO | WO 2012/133391 | 10/2012 |
| WO | WO 2012/144490 | 10/2012 |
| WO | WO 2013/040339 | 3/2013 |

OTHER PUBLICATIONS

Official Action for Canadian Patent Application No. 3048957, dated Nov. 19, 2020, 4 pages.

Official Action (no English translation available) for Algerian Patent Application No. 190369, dated Dec. 21, 2020, 1 page.

Official Action for European Patent Application No. 16829052.6, dated Oct. 9, 2020, 5 pages.

Official Action for India Patent Application No. 201918037015, dated Dec. 2, 2020 5 pages.

Official Action (no English translation available) for Panama Patent Application No. 90904, dated Oct. 29, 2020 3 pages.

Official Action for U.S. Appl. No. 15/826,394, dated Dec. 21, 2020 16 pages.

"Aluminium in the Packaging Industry: Manufacture, Use, Recycling," Gesamtverband Der Aluminium Industrie e.V., 2006, 16 pages [retrieved online from: www.aluinfo.de/files/_media/dokumente/Downloads/Technische%20Daten/Merkblaetter/W18_Aluminium_in_the_Packaging_Industry.pdf].

"Impact Extrusion," Wikipedia, Dec. 9, 2009 retrieved from https://web.archive.org/web/20091209012819/http://en.wikipedia.org/wiki/Impact_extrusion, 5 pages.

Cui et al. "Recycling of automotive aluminum," Transactions of Nonferrous Metals Society of China, Nov. 2010, vol. 20, No. 11, pp. 2057-2063.

Fisher et al. "Recycling—The Effect On Grain Refinement of Commercial Aluminum Alloys," London & Scandinavian Metallurgical Co Limited, 122nd TMS Annual Meeting & Exhibition, Feb. 21-25, 1993, 6 pages.

Goltz "Aluminum Bottles are Successful," University of Wisconsin, 2005, 5 pages [retrieved from: http://www2.uwstout.edu/content/rs/2005/article6.pdf].

Guley et al. "Direct recycling of 1050 aluminum alloy scrap material mixed with 6060 aluminum alloy chips by hot extrusion." International Journal of Material Forming, Apr. 2010, vol. 3, No. Suppl. 1, pp. 853-856.

Herbert, "Manufacturing Processes," Prentice-Hall, Inc., Englewood Cliffs, NJ, excerpts from pp. 548-553, 562-563, 1979, 11 pages.

Sanders, Jr. "Technology Innovation in Aluminum Products," JOM, Feb. 2001, vol. 53, No. 2, pp. 21-25 (pp. 21-22).

Tekkaya et al. "Hot profile extrusion of AA-6060 aluminum chips," Journal of Materials Processing Technology, Apr. 2009, vol. 209, No. 7, pp. 3343-3350.

International Search Report and Written Opinion for International Patent Application No. PCT/US12/55390, mailed Nov. 21, 2012, 8 pages.

International Preliminary Report on Patentability for International (PCT) Patent Application No. PCT/US2012/055390, mailed Mar. 27, 2014 8 pages.

Official Action for Australia Patent Application No. 2012308416, dated Jul. 03, 2015 3 pages Official Action for Australia Patent Application No. 2012308416, dated Apr. 13, 2016 4 pages.

Notice of Acceptance for Australia Patent Application No. 2012308416, dated Jul. 5, 2016 2 pages.

Official Action for Australia Patent Application No. 2016204457, dated Oct. 6, 2017 3 pages.

Official Action for Australia Patent Application No. 2016204457, dated Sep. 3, 2018 3 pages.

Official Action for Australia Patent Application No. 2018241184, dated Dec. 17, 2019 3 pages.

Notice of Allowance for Australia Patent Application No. 2018241184, dated May 18, 2020 4 pages.

Official Action with English Translation for Brazil Patent Application No. BR112014006382-6, dated Mar. 23, 2018 14 pages.

Official Action with English Translation for Brazil Patent Application No. BR112014006382-6, dated Jan. 18, 2019 7 pages.

Official Action for U.S. Patent Application No. BR122018017039-5, dated Apr. 11, 2019 9 pages.

Official Action with English Translation for Brazil Patent Application No. BR122018017039-5, dated Nov. 5, 2019 9 pages.

Official Action (no English translation) for Brazil Patent Application No. BR122018017039-5, dated Mar. 4, 2020 4 pages.

(56) References Cited

OTHER PUBLICATIONS

Official Action for Canada Patent Application No. 2,848,846, mailed Feb. 19, 2016 6 pages.
Official Action for Canada Patent Application No. 2,848,846, mailed Dec. 20, 2016 3 pages.
Official Action for Canada Patent Application No. 2,848,846, dated Oct. 18, 2017 5 pages.
Official Action for Canada Patent Application No. 2,848,846, dated Apr. 27, 2018 3 pages.
Notice of Allowance for Canada Patent Application No. 2,848,846, dated Feb. 5, 2019.
Official Action for Canada Patent Application No. 2,979,863, dated Sep. 21, 2018 6 pages.
Notice of Allowance for Canada Patent Application No. 2,979,863, dated May 15, 2019 1 page.
Official Action with English Translation for China Patent Application No. 201280045120.2, dated Jul. 21, 2015 19 pages.
Official Action (English Translation) for China Patent Application No. 201280045120.2, dated Jan. 15, 2016 10 pages.
Official Action (with English Translation) for China Patent Application No. 201280045120.2, dated Aug. 3, 2016 23 pages.
Official Action with English Translation for China Patent Application No. 201280045120.2, dated Mar. 23, 2017 19 pages.
Notice of Reexamination with English Translation for China Patent Application No. 201280045120.2, dated Mar. 22, 2018 22 pages.
Notice of Reexamination with English Translation for China Patent Application No. 201280045120.2, dated Aug. 28, 2018 24 pages.
Reexamination Decision for China Patent Application No. 201280045120.2,dated Mar. 20, 2019 19 pages.
Official Action (with English translation) for Chinese Patent Application No. 201910531300.5, dated Aug. 18, 2020, 19 pages.
Extended Search Report for European Patent Application No. 12831344.2, dated Feb. 5, 2016 10 pages.
Official Action for European Patent Application No. 12831344.2, dated Dec. 13, 2017 4 pages.
Official Action for European Patent Application No. 12831344.2, dated Sep. 28, 2018 4 pages.
Official Action for European Patent Application No. 12831344.2, dated Jul. 24, 2019 4 pages.
Official Action for European Patent Application No. 12831344.2, dated Apr. 30, 2020 3 pages.
Extended Search Report for European Patent Application No. 16189160.1, dated Feb. 20, 2017 9 pages.
Official Action for European Patent Application No. 16189160.1, dated Jan. 24, 2018 4 pages.
Official Action for European Patent Application No. 16189160.1, dated Jan. 2, 2019 4 pages.
Summons to Attend Oral Proceedings for European Patent Application No. 16189160.1, dated Oct. 11, 2019 4 pages.
Intent to Grant European Patent Application No. 16189160.1, dated Jun. 5, 202, 5 pages.
Extended Search Report for European Patent Application No. 16189165, dated Feb. 10, 2017 7 pages.
Official Action for European Patent Application No. 16189165.0, dated Jan. 23, 2018 4 pages.
Official Action for European Patent Application No. 16189165.0, dated Oct. 17, 2018 4 pages.
Official Action for European Patent Application No. 16189165.0, dated Jun. 7, 2019 4 pages
Summons to Attend Oral Proceedings for European Patent Application No. 16189165.0, dated Dec. 11, 2019, 2 pages.
Official Action with English Translation for Indonesia Patent Application No. P00201804102, dated Jan. 31, 2020 4 pages.
Official Action for India Patent Application No. 2983/DELNP/2014, dated Mar. 5, 2019 6 pages.
Official Action with English Translation for So. Korean Patent Application No. 10-2014-7010144, dated Oct. 20, 2015 11 pages.
Official Action with English Translation for So. Korean Patent Application No. 10-2014-7010144, dated May 10, 2016 9 pages.
Official Action with English Translation for So. Korean Patent Application No. 10-2014-7010144, dated Sep. 7, 2016 8 pages.
Official Action with English Summary for Korea Patent Application No. 10-2016-7021608, dated Oct. 27, 2017 11 pages.
Official Action with English Summary for Korea Patent Application No. 10-2016-7027755, mailed Dec. 8, 2016 9 pages.
Official Action with English Summary for Korea Patent Application No. 10-2016-7027755, dated May 29, 2017 10 pages.
Notice of Allowance with English Translation for Korea Patent Application No. 10-2016-7027755. dated Oct. 27, 2017 4 pages.
Official Action for Mexican Patent Application No. MX/a/2014/002907, dated Apr. 29, 2016, 3 pages (English translation unavailable).
Notice of Allowance for Mexican Patent Application No. MX/a/2014/002907, dated Jul. 8, 2016, 1 page (English translation unavailable).
Official Action with English Translation for Russian Patent Application No. 2014115212, dated Oct. 21, 2015 8 pages.
Decision on Grant with English Translation for Russia Patent Application No. 2014115212/02, dated Mar. 18, 2016 15 pages.
Official Action with English Translation for Ukraine Patent Application No. a 2014 04043, dated Jan. 16, 2016 11 pages.
Decision to Grant with English Translation for Ukraine Patent Application No. a201404043, dated Mar. 14, 2017 10 pages.
Official Action with English Translation for Vietnam Patent Application No. 1-2014-01220, dated Jun. 4, 2019 4 pages.
Decision to Grant (with English Translation) Vietnam Patent Application No. 1-2014-01220, dated May 25, 2020 2 pages.
Official Action with English Translation for Saudi Arabia Patent Application No. 112330856, dated Dec. 14, 2015 8 pages
Official Action for Saudi Arabia Patent Application No. 112330856, received Mar. 8, 2017 4 pages
Official Action (with English translation) for Saudi Arabia Patent Application No. 112330856, received Jan. 24, 2017 7 pages.
International Search Report and Written Opinion for International Patent Application No. PCT/US16/69454, mailed Jul. 28, 2017, 11 pages.
International Preliminary Report on Patentability for International (PCT) Patent Application No. PCT/US2016/069454, dated Jul. 11, 2019 7 pages.
Official Action for Australian Patent Application No. 2016433840, dated Dec. 2, 2019, 4 pages.
Official Action for Australian Patent Application No. 2016433840, dated Jul. 29, 2020, 4 pages.
Notice of Acceptance for Australian Patent Application No. 2016433840, dated Oct. 2, 2020, 4 pages.
Official Action with English Translation for Brazil Patent Application No. BR112019013568-5, dated Mar. 12, 2020 5 pages.
Official Action (with English translation) for Russia Patent Application No. 2019123823, dated Feb. 10, 2020 2 pages.
Decision to Grant (No English translation) for Russia Patent Application No. 2019123823, dated Feb. 10, 2020 11 pages.
International Search Report and Written Opinion for International (PCT) Patent Application No. PCT/US2014/033182, mailed Nov. 25, 2014, 11 pages.
International Preliminary Report on Patentability for International (PCT) Patent Application No. PCT/US2014/033182, mailed Oct. 22, 2015, 8 pages.
Official Action for Australia Patent Application No. 2014251206, dated Jun. 9, 2017 5 pages.
Official Action for Canadian Patent Application No. 2,908,181, mailed Sep. 26, 2016 6 pages.
Notice of Allowance for Canadian Patent Application No. 2,908,181, mailed Jun. 21, 2017 1 page.
Official Action for Canada Patent Application No. 2,990,040, dated Oct. 29, 2018 4 pages.
Official Action for Canada Patent Application No. 2,990,040, dated May 16, 2019 4 pages.
Official Action for Canada Patent Application No. 2,990,040, dated Jan. 24, 2020 4 pages.
Official Action for Canada Patent Application No. 2,990,040, dated Sep. 4, 2020 4 pages.

(56) References Cited

OTHER PUBLICATIONS

Official Action (English Translation) for Chinese Patent Application No. 201480032990.5, dated Aug. 31, 2016 8 pages.
English Translation of Office Action for China Patent Application No. 2017052201683100, dated May 25, 2017 3 pages.
Notice of Allowance (with English Translation) for China Patent Application No. 2017052201683100, dated Sep. 27, 2017 5 pages.
Official Action for Colombian Patent Application No. 15-265549, dated Dec. 1, 2015.
English Translation of Official Action for Colombia Patent Application No. 15-265549, dated Jul. 7, 2017 3 pages.
Partial Supplementary Search Report for European Patent Application No. 14782344.7, dated Mar. 29, 2017 16 pages.
Extended European Search Report for European Patent Application No. 14782344.7, dated Sep. 13, 2017 16 pages.
Official Action for Euopean Patent Application No. 14782344.7, dated Feb. 24, 2020 4 pages.
Official Action for India Patent Application No. 8993/DELNP/2015, dated Apr. 16, 2019 9 pages.
Official Action for Japan Patent Application No. 2016-507586, dated Aug. 08. 2017 3 pages.
Notice of Allowance with English Translation for Japan Patent Application No. 2016-507586, dated Nov. 1, 2017 2 pages.
Official Action with English Translation for Russia Patent Application No. 2015147899, dated Apr. 17, 2017 11 pages.
Official Action (English Translation) for Russia Patent Application No. 2015147899, dated Aug. 23, 2017 5 pages.
Official Action (English translation) for Vietnamese Patent Application No. 1-2015-04151, dated Jul. 20, 2020, 2 pages.
Official Action for U.S. Appl. No. 13/617,119, mailed Aug. 6, 2015 6 pages Restriction Requirement.
Official Action for U.S. Appl. No. 13/617,119, mailed Sep. 24, 2015 7 pages.
Notice of Allowance for U.S. Appl. No. 13/617,119, mailed Mar. 3, 2016 10 pages.
Official Action for U.S. Appl. No. 13/617,119, mailed Jun. 8, 2016 8 pages.
Official Action for U.S. Appl. No. 13/617,119, mailed Oct. 18, 2016 9 pages.
Notice of Allowance for U.S. Appl. No. 13/617,119, mailed Mar. 24, 2017 9 pages.
Official Action for U.S. Appl. No. 15/098,654, dated Sep. 24, 2018 6 pages Restriction Requirement.
Official Action for U.S. Appl. No. 15/098,654, dated Jan. 7, 2019 7 pages.
Official Action for U.S. Appl. No. 15/098,654, dated Jun. 24, 2019 8 pages.
Notice of Allowance for U.S. Appl. No. 15/098,654, dated Oct. 18, 2019 8 pages.
Official Action for U.S. Appl. No. 16/474,953, dated Sep. 17, 2020, 7 pages. Restriction Requirement.
Official Action for U.S. Appl. No. 14/246,728, mailed Oct. 19, 2015 6 pages Restriction Requirement.
Official Action for U.S. Appl. No. 14/246,728, mailed Jan. 14, 2016 16 pages.
Final Action for U.S. Appl. No. 14/246,728, mailed May 26, 2016 11 pages.
Notice of Allowance for U.S. Appl. No. 14/246,728, mailed Aug. 15, 2016 8 pages.
Notice of Allowance for U.S. Appl. No. 15/279,127, mailed Aug. 4, 2017 10 pages.
Official Action for U.S. Appl. No. 15/826,394, dated Jan. 28, 2020 6 pages Restriciton Requirement.
Official Action for U.S. Appl. No. 15/826,394, dated Jun. 26, 2020 12 pages.
Notice of Allowance for Canada Patent Application No. 3,040,764, dated Jan. 21, 2021, 1 page.
Official Action (with English translation) for Chinese Patent Application No. 201910531300.5, dated Apr. 14, 2021, 34 pages.
Office Action for European Patent Application No. 12831344.2, dated Mar. 31, 2021, 3 pages.
Official Action for Mexico Patent Application No. MX/a/2016/008664, dated Jan. 27, 2021, 4 pages.
Official Action (with English translation) for India Patent Application No. 20197027888, dated Feb. 10, 2021, 6 pages.
Notice of Allowance for Canada Patent Application No. 2,990,040, dated Mar. 3, 2021 1 page.
Summons to Attend Oral Proceedings for European Patent Application No. 14782344.7, dated Apr. 23, 2021, 4pages.
Official Action for U.S. Appl. No. 16/474,953, dated Apr. 16, 2021, 14 pages.
Guanglin et al., "Packaging Material Science," Aug. 31, 2011, pp. 243-244 (No English translation available).
Xiao et al., "Practical Manual of Aluminum Processing Technology," Metallurgical Industry Press, Beijing, China, 2005, 14 pages (No English translation available).
U.S. Appl. No. 13/617,119, filed Sep. 14, 2012 now U.S. Pat. No. 9,663,846.
U.S. Appl. No. 15/395,496, filed Dec. 30, 2016.
U.S. Appl. No. 16/474,953, filed Jun. 28, 2019.
U.S. Appl. No. 15/098,654, filed Apr. 14, 2016 now U.S. Pat. No. 10,584,402.
U.S. Appl. No. 14/246,728, filed Apr. 7, 2014 now U.S. Pat. No. 9,517,498.
U.S. Appl. No. 15/279,127, filed Sep. 28, 2016 now U.S. Pat. No. 9,844,805.
U.S. Appl. No. 15/826,394, filed Nov. 29, 2017.
Intent to Grant European Patent Application No. 16189165.0, dated Oct. 12, 2020, 39 pages, dated Dec. 12, 2020, 39 pages.
Official Action for Australia Patent Application No. 2020239684, dated Aug. 27, 2021, 4 pages.
Official Action with English Translation for Brazil Patent Application No. BR112019013568-5, dated Jul. 26, 2021 9 pages.
Official Action for European Patent Application No. 16829052.6, dated Jul. 30, 2021, 3 pages.
Notice of Allowance for Mexico Patent Application No. MX/a/2015/013932, dated Sep. 13, 2021, 2 pages.
Official Action for U.S. Appl. No. 16/474,953, dated Aug. 20, 2021, 10 pages.
Official Action (with English translation) for Brazil Patent Application No. BR122020012460-1, 6 pages.
Official Action (with English translation) for Chinese Patent Application No. 201910531300.5, dated Sep. 10, 2021, 13 pages.
Official Action for Mexico Patent Application No. MX/a/2016/008664, dated Aug. 10, 2021, 3 pages.
Official Action for U.S. Appl. No. 16/474,953, dated Mar. 18, 2022, 16 pages.
"Aerobal "World Aluminum Aerosol Can Award 2010" Stylish can design and "greener" production technology," Unipak, Sep. 27, 2010, 1 page.
"Aerocan and Tubex pick up 2010 aluminium aerosol can awards," Cosmetics Business, Sep. 28, 2010 retrieved from https://www.cosmeticsbusiness.com/news/article_page/Aerocan_and_Tubex_pick_up_2010_aluminium_aerosol_can_awards/56955, 1 page.
"DIN EN 573-3," DIN, Aug. 2009, 3 pages.
"International Alloy Designations and Chemical Composition Limits for Wrought Aluminum and Wrought Aluminum Alloys," The Aluminum Association, Feb. 2009, 37 pages.
Notices of Opposition filed in Europe Patent Application No. 16189160.1, dated Aug. 4, 2021, 26 pages.
Official Action for India Patent Application No. 201918034863, dated Jul. 13, 2021 6 pages.
Official Action for India Patent Application No. 201918034864, dated Aug. 3, 2021 6 pages.
Official Action for Canadian Patent Application No. 3048957, dated Jun. 7, 2021, 4 pages.
Official Action for Indonesia Patent Application No. PID201906548, dated May 19, 2021, 2 pages.
Official Action for Mexico Patent Application No. MX/a/2015/013932, dated Jun. 18, 2021, 6 pages.
Intent to Grant European Patent Application No. 12831344.2, dated Jan. 7, 2022, 40 pages.

(56) References Cited

OTHER PUBLICATIONS

Official Action for Canadian Patent Application No. 3048957, dated Dec. 15, 2021, 4 pages.
Opponent's Reply to Appeal for Europe Patent Application No. 16189165.0, dated Sep. 16, 2024, 18 pages.
"Casthouse Seminar, Fourth edition 1998," Alusuisse Technology & Management Ltd., 1998, 13 pages.
"7000 Aluminum Impact Extrusion Slugs Per Minute," Modern Metals: Porcelain on Aluminum, vol. XVIII, No. 5, Jun. 1962, 3 pages.
"Material Safety Data Sheet: Zinc Stearate Ed Hs Powder," PMC Group, Feb. 29, 2008, 7 pages.
"Titanium Boron Aluminium Grain Refiners for Aluminium—Silicon Alloys (Al—Si)," AZO Materials, Apr. 7, 2006, retrieved from https://www.azom.com/article.aspx?ArticleID=3354, 2 pages.
Titanium Boron Aluminium Grain Refiners, AMG Aluminum, Date Unknown, 1 page.
Altenpohl, "Aluminium und Aluminiumlegierungen," Springer-Verlag, Berlin, 1965, pp. 24-33.
Asbjornsson, "Dispersion of Grain Refiner Particles in Molten Aluminium," Thesis submitted to the University of Nottingham for the degree of Doctor of Philosophy, Jul. 2001, pp. 9-10.
Easton et al., "Optimising the cost of grain refinement by separate TiB2 and Ti additions to wrought aluminium alloys," Proceeding of the Australian Asian Pacific Conference on Aluminium Cast House Technology, Sep. 14, 2003, 2 pages (abstract only).
Guthrie, "On the Detection, Behaviour and Control of Inclusions in Liquid Metals," in Foundry Processes: Their Chemistry and Physics (ed. Katz et al.), Plenum Press, New York, NY, 1988, pp. 447-466.
Lange et al., "Fließpressen," Springer, 2008, pp. 94-95.
Lange et al., "Fließpressen," Springer, 2008, pp. 107-110.
Loong et al., "Grain Refining OP Aluminium Foundry Alloys," [sic] Comalco Research Centre, Date Unknown, pp. 21, 24.
Semiatin, "Glossary of Terms," ASM Handbook, vol. 14B: Metalworking: Sheet Forming, 2006, pp. 861-886.
Siegert, "Fließpressen von Aluminium, Band 1" Institut Für Umformtechnik Universtität Stuttgart, Informationsgesellschaft/Verlag, Oct. 6, 1995, p. 183.
Taschauer et al., "Einflüsse Auf Die Umformbarkeit Von Aerosolspraydosen," in 4. Sommerschule Umformtechnik Kaltumformung, Jun. 2006, pp. 125-130.
Taschauer, "Werkstoffkundliche und verfahrenstechnische Einflusse bei der Herstellung von Aluminium-Aerosolspraydosen," Studienrichtung Werkstoffwissenschaft, Leoben, Nov. 2009, 116 pages.
Official Action (with English translation) for Argentina Patent Application No. P180101150, dated Oct. 21, 2021, 15 pages.
Official Action (with English summary) for Argentina Patent Application No. P180101150, dated Jul. 1, 2022, 9 pages.
Notice of Allowance for Australian Patent Application No. 2020230322, dated Nov. 16, 2021, 4 pages.
Official Action (with English translation) for Chinese Patent Application No. 201910531300.5, dated Dec. 7, 2021, 22 pages.
Intent to Grant Europe Patent Application No. 12831344.2, dated Jan. 7, 2022, 40 pages.
Official Action for Europe Patent Application No. 12831344.2, dated Mar. 13, 2023, 3 pages.
Intent to Grant Europe Patent Application No. 12831344.2, dated Nov. 8, 2023, 8 pages.
Intent to Grant Europe Patent Application No. 12831344.2, dated Apr. 24, 2024, 8 pages.
Letter from the Opponent filed in Europe Patent Application No. 16189160.1, dated Apr. 5, 2022, 20 pages.
Brief Communication in Opposition Proceedings for Europe Patent Application No. 16189160.1, dated Apr. 12, 2024, 15 pages.
Summons to Attend Oral Proceedings for Europe Patent Application No. 16189160.1, dated Apr. 18, 2024, 29 pages.
Notice of Opposition for Europe Patent Application No. 16189165.0, dated Mar. 4, 2022, 15 pages.
Notice of Opposition for European Patent Application No. 16189165.0, dated Dec. 9, 2022, 6 pages.
Summons to Attend Oral Proceedings for Europe Patent Application No. 16189165.0, dated Apr. 6, 2023, 32 pages.
Written Submission in Opposition Proceedings for Europe Patent Application No. 16189165.0, dated Oct. 27, 2023, 11 pages.
Decision in Opposition Proceedings for Europe Patent Application No. 16189165.0, dated Jan. 11, 2024, 33 pages.
Official Action for India Patent Application No. 201918034863, dated Feb. 5, 2024 2 pages.
Hearing Adjournment Notice for India Patent Application No. 201918034863, dated Mar. 5, 2024, 2 pages.
Hearing Adjournment Notice for India Patent Application No. 201918034863, dated Apr. 1, 2024, 2 pages.
Official Action for India Patent Application No. 201918034864, dated Feb. 6, 2024 2 pages.
Hearing Adjournment Notice for India Patent Application No. 201918034864, dated Mar. 5, 2024, 2 pages.
Hearing Adjournment Notice for India Patent Application No. 201918034864, dated Apr. 1, 2024, 2 pages.
Notice of Allowance for Mexico Patent Application No. MX/a/2016/008664, dated Feb. 17, 2022, 2 pages.
Official Action (with English translation) for Thailand Patent Application No. 1401001374, dated Apr. 23, 2024, 2 pages.
Notice of Allowance for Australia Patent Application No. 2020239684, dated Jun. 2, 2022, 4 pages.
Official Action for Brazil Patent Application No. BR112019013568-5, dated Dec. 14, 2021, 5 pages.
Official Action (with English translation) for Brazil Patent Application No. BR122020012460-1, received Aug. 3, 2021, 6 pages.
Official Action (with English translation) for Brazil Patent Application No. BR122020012460-1, received Jan. 18, 2022, 7 pages.
Notice of Allowance for Brazil Patent Application No. BR122020012460-1, dated Jul. 12, 2022, 2 pages.
Official Action for Canada Patent Application No. 3048957, dated Dec. 15, 2021, 4 pages.
Official Action for Canada Patent Application No. 3048957, dated Jul. 18, 2022, 1 page.
Official Action for Canada Patent Application No. 3177802, dated Jan. 15, 2024, 4 page.
Official Action for Canada Patent Application No. 3177802, dated Jun. 5, 2024, 3 pages.
Summons to Attend Oral Proceedings for European Patent Application No. 16829052.6, dated Jun. 23, 2022, 8 pages.
Official Action for European Patent Application No. 16829052.6, dated Dec. 15, 2022, 22 pages.
Extended European Search Report for European Patent Application No. 23158496.2, dated Jun. 26, 2023 8 pages.
Notice of Hearing (with English translation) for India Patent Application No. 201917027888, dated Sep. 6, 2023, 2 pages.
Official Action (with English translation) for India Patent Application No. 201917027888, dated Oct. 10, 2023, 2 pages.
Official Action for Mexico Patent Application No. MX/a/2019/007930, dated Mar. 7, 2024, 3 pages.
Intent to Grant Europe Patent Application No. 14782344.7, dated Nov. 11, 2021 7 pages.
Official Action for India Patent Application No. 201918037015, dated Aug. 1, 2023, 2 pages.
Notice of Allowance for U.S. Appl. No. 16/474,953, dated Jul. 12, 2022, 10 pages.
Official Action for U.S. Appl. No. 18/074,644, dated May 22, 2023, 6 pages. Restriction Requirement.
Official Action for U.S. Appl. No. 18/074,644, dated Aug. 23, 2023, 10 pages.
Notice of Allowance for U.S. Appl. No. 18/074,644, dated Dec. 13, 2023, 9 pages.
Notice of Allowance for U.S. Appl. No. 18/074,644, dated Jun. 12, 2024, 8 pages.
Official Action for U.S. Appl. No. 17/205,963, dated Jan. 18, 2024 14 pages.
U.S. Appl. No. 18/908,497, filed Oct. 7, 2024, Siles et al.

(56) References Cited

OTHER PUBLICATIONS

Mondolfo, "Al—Cr Aluminum-Chromium system," in "Aluminum Alloys Structures & Properties," Butterworths London-Boston, 1976, pp. 249-253.
Mondolfo, "Al—Cu Aluminum-Copper system," in "Aluminum Alloys Structures & Properties," Butterworths London-Boston, 1976, pp. 253-278.
Mondolfo, "Al—Fe Aluminum-Iron system," in "Aluminum Alloys Structures & Properties," Butterworths London-Boston, 1976, pp. 282-289.
Mondolfo, "Al—Mg Aluminum-Magnesium system," in "Aluminum Alloys Structures & Properties," Butterworths London-Boston, 1976, pp. 311-323.
Mondolfo, "Al—Mn Aluminum-Manganese system," in "Aluminum Alloys Structures & Properties," Butterworths London-Boston, 1976, pp. 324-329.
Mondolfo, "Al—Zn Aluminum-Zinc system," in "Aluminum Alloys Structures & Properties," Butterworths London-Boston, 1976, pp. 398-413.
Official Action (no English translation available) for Thailand Patent Application No. 1401001374, dated Sep. 29, 2024, 1 page.
Official Action for Mexico Patent Application No. MX/a/2019/007930, dated Sep. 4, 2024, 4 pages.
Official Action for U.S. Appl. No. 17/205,963, dated Nov. 15, 2024, 10 pages.
Anderson et al., "3105—Sheet Alloy," ASM Handbook, vol. 2B: Properties and Selection of Aluminum Alloys, 2019, pp. 340-341.
Interlocutory Decision in Opposition Proceedings for Europe Patent Application No. 16189160.1, dated Jan. 29, 2025, 26 pages.
Notice of Allowance for Thailand Patent Application No. 1401001374, dated Dec. 9, 2024, 1 page.
Notice of Allowance for Mexico Patent Application No. MX/a/2019/007930, dated Feb. 5, 2025, 3 pages.
Official Action Appendix and Interview Summary for U.S. Appl. No. 17/205,963, dated Jan. 21, 2025, 11 pages.
Notice of Allowance for U.S. Appl. No. 17/205,963, dated Feb. 13, 2025, 8 pages.

* cited by examiner

IMPACT EXTRUDED CONTAINERS FROM RECYCLED ALUMINUM SCRAP

CROSS-REFERENCE TO RELATED APPLICATION

This application is a divisional application of Ser. No. 15/098,654, which issued as U.S. Pat. No. 10,584,402 on Mar. 10, 2020, which is a divisional application of U.S. Ser. No. 13/617,119, filed on Sep. 14, 2012, which issued as U.S. Pat. No. 9,663,846 on May 30, 2017, which claims priority to and the benefit under 35 U.S.C. § 119(e) to U.S. Provisional Patent Application Ser. No. 61/535,807 filed Sep. 16, 2011. Each reference is incorporated by reference in their entirety.

FIELD OF THE INVENTION

The present invention relates generally to alloys, including those made from recycled materials and used in the manufacturing of aluminum containers by a process known as impact extrusion. More specifically, the present invention relates to methods, apparatus and alloy compositions used in the manufacturing of slugs used to make containers and other articles from impact extrusion.

BACKGROUND

Impact extrusion is a process utilized to make metallic containers and other articles with unique shapes. The products are typically made from a softened metal slug comprised of steel, magnesium, copper, aluminum, tin or lead. The container is formed inside the confining die from a cold slug which is contacted by a punch. The force from the punch deforms the metal slug around the punch on the inside, and the die along the outside surface. After the initial shape is formed, the container or other apparatus is removed from the punch with a counter-punch ejector, and other necking and shaping tools are used to form the device to a preferred shape. Traditional impact extruded containers include aerosol containers and other pressure vessels which require high strength, and thus use thicker gage and heavier materials than traditional aluminum beverage containers. Because of the thickness and strength requirements of these containers, the cost to manufacture the containers may be significant when compared to conventional metal beverage containers which generally utilize 3104 aluminum. In a conventional impact extrusion process, almost pure or "virgin" aluminum is used due to its unique physical characteristics, and is commonly referred to as "1070" or "1050" aluminum which is comprised of at least about 99.5% of pure aluminum.

Due to the complexity of creating complex shapes with soft metals such as aluminum, critical metallurgical characteristics must be present for the impact extrusion process to work. This includes but is not limited to the use of very pure, soft aluminum alloys, which typically contain at least about 99% pure virgin aluminum. Because of this requirement, the use of recycled materials, for example aluminum alloys 3104, 3105, or 3004 scrap aluminum, have not been feasible for use in the impact extrusion process for aerosol and beverage containers.

Thus there is a significant need to find a lightweight yet strong aluminum alloy to form impact extruded containers and other useful articles, and to utilize scrap aluminum from other manufacturing processes to benefit the environment and save valuable natural resources.

SUMMARY OF THE INVENTION

Accordingly, the present invention contemplates a novel system, device, and methods for using scrap aluminum materials, such as 3104, 3004, 3003, 3013, 3103 and 3105 aluminum in combination with other metal materials to create a unique and novel aluminum alloy which may be used during an impact extrusion process to form various shaped containers and other articles. Although generally referred to herein as "containers" it should be appreciated that the current process and alloy compositions may be used in the impact extrusion process to form any variety of shaped containers or other articles of manufacture.

Thus, in one embodiment of the present invention, a novel alloy is provided in the initial form of a metal slug to form a metallic container in an impact extrusion process. The alloy in one embodiment has a composition comprising a recycled 3105 or 3104 aluminum, and a relatively pure 1070 aluminum to form a novel recycled alloy. In one embodiment, a recycled aluminum alloy which utilizes 40% of 3104 alloy is blended with a 1070 alloy, and which comprises the following composition:

approximately 98.47% aluminum
approximately 0.15% Si;
approximately 0.31% Fe;
approximately 0.09% Cu;
approximately 0.41% Mn;
approximately 0.49% Mg;
approximately 0.05% Zn;
approximately 0.02% Cr; and
approximately 0.01% Ti.

As provided in the tables, claims, and detailed description below, various compositions of aluminum alloys are provided and contemplated herein. For each alloy, the amount of each component, i.e., Si, Fe, Cu, etc. may be varied approximately 15% to achieve satisfactory results. Furthermore, as appreciated by one skilled in the art, it is not necessary that the novel alloy compositions described herein and used in the impact extrusion process be comprised entirely or in part with recycled components and alloys. Rather, the alloys may be obtained and blended from stock materials which have not previously been used or implemented in previous products or processes.

In another aspect of the present invention, a novel manufacturing process may be provided to form the unique alloys, and includes but is not limited to the blending of various scrap materials with other virgin metals to create a unique alloy specifically adapted for use in an impact extrusion process.

In another aspect of the present invention, specific tools such as neckers and other devices commonly known in the container manufacturing business are contemplated for use with the novel alloys and which are used in conjunction with the impact extrusion process. Further novel manufacturing techniques associated with using the novel alloy compositions are also contemplated with the present invention.

In yet another aspect of the present invention, a distinctly shaped container or other article is provided which is comprised of one or more of the novel recycled alloys provided and described herein. Although these containers are most suitable for aerosol containers and other types of pressure vessels, the compositions and processes described herein may be used to make any type of shaped metallic container.

In various embodiments of the present invention, lightweight containers comprising recycled contents are provided. At least one of the following advantages may be realized: strength to weight ratio; burst pressures; deformation pressures; dent resistance; resistance to scratching or galling; and/or reduction in weight and metal content. Other advantages are also contemplated. Furthermore, aspects and features of the present invention provide for containers with increased resistance to back annealing allowing higher cure temperature lining materials. In various embodiments, an alloy for producing impact extruded containers with higher back annealing resistance is contemplated, resulting in improved container performance, and utilizing coatings requiring higher curing temperatures. Container designs and tooling designs for producing such containers are also contemplated.

In various embodiments of the present invention, an aluminum slug and corresponding impact extruded container comprising recycled material is provided. The recycled content may be post-industrial or post-consumer content, the use of which enhances overall product and process efficiency. A significant portion of known scrap, such as offal from cup making processes, contains a higher concentration of alloying elements than the base 1070 alloy currently used. These alloying elements, while providing various cost and environmental advantages, modify the metallurgical characteristics of the aluminum. For example, inclusion of these elements increases the solidification temperature range. Casting challenges are thus present. As yield strength increases and the ductility decreases, issues are created with respect to rolling the strip, for example. Recrystallization characteristics are known to change, necessitating potential changes to the thermomechanical treatment(s), including but not limited to: rolling temperatures, rolling reductions, annealing temperatures, annealing process, and/or annealing times. The increased ultimate tensile strength and yield strength increases the tonnage loads when punching slugs.

Additionally, surface roughness and lubrication of the slugs of the present invention is critical due to the modified metallurgical characteristics. Tonnage loads on the extrusion presses are typically higher in connection with slugs of the present invention. In various embodiments, the increased material strength of the present invention enables attainment of standard container performance specifications at significantly lower container weights and/or wall thicknesses.

Thus, in one aspect of the present invention a method of manufacturing a slug used in an impact extrusion process from recycled scrap material is provided, and comprising:

- providing a scrap metal comprising at least one of a 3104, a 3004, 3003, 3013, 3103 and a 3105 aluminum alloy;
- blending said at least one of said 3104, said 3004, 3003, 3013, 3103 and said 3104 aluminum alloy with a relatively pure aluminum alloy to create a recycled aluminum alloy;
- adding a titanium boride material to said recycled aluminum alloy;
- forming a slug with said recycled aluminum alloy after heating;
- deforming said slug comprised of said recycled aluminum alloy into a preferred shape in an impact extrusion process to form a shaped container.

The Summary of the Invention is neither intended nor should it be construed as being representative of the full extent and scope of the present disclosure. The present disclosure is set forth in various levels of detail in the Summary of the Invention as well as in the attached drawings and the Detailed Description of the Invention and no limitation as to the scope of the present disclosure is intended by either the inclusion or non-inclusion of elements, components, etc. in this Summary of the Invention. Additional aspects of the present disclosure will become more readily apparent from the Detailed Description, particularly when taken together with the drawings.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as, in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

DETAILED DESCRIPTION

Figure 1:
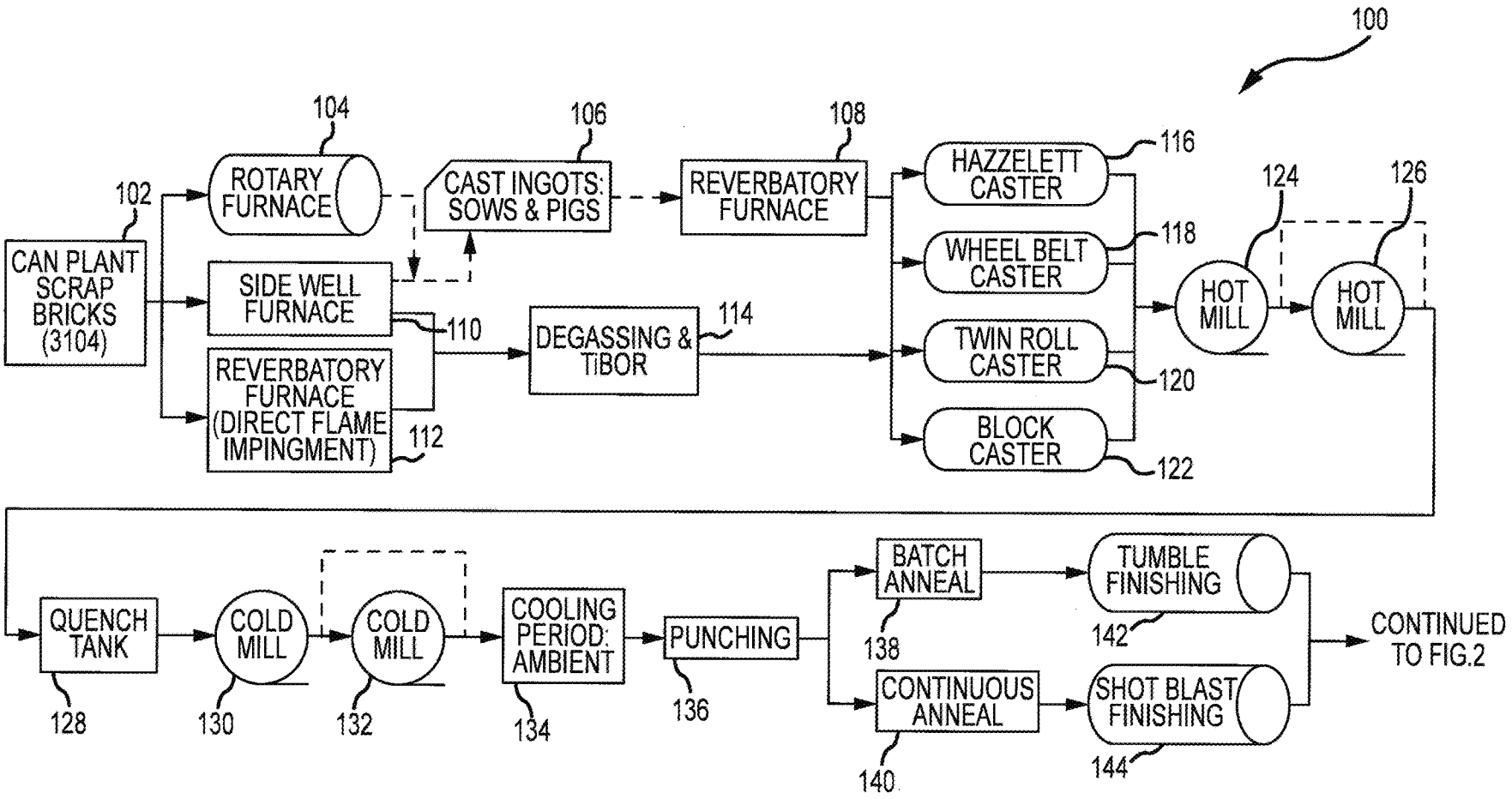
FIG. 1 illustrates a method for manufacturing an alloy slug from a recycled aluminum material.

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment of the method that illustrates the best mode now contemplated for putting the invention into practice is described herein by, and with reference to, the annexed drawings that form a part of the specification. The exemplary method is described in detail without attempting to describe all of the various forms and modifications in which the invention might be embodied. As such, the embodiments described herein are illustrative, and as will become apparent to those skilled in the arts, may be modified in numerous ways within the scope and spirit of the invention.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

As provided in the attached tables and text, various aluminum alloys are identified by numerical indications such as 1070 or 3104. As appreciated by one skilled in the art, aluminum is designated by its major corresponding alloying elements, typically in four-digit arrangement. The first of these four numbers corresponds to a group of aluminum alloys sharing a major alloying element, such as 2XXX for copper, 3XXX for manganese, 4XXX for silicon, etc. Thus, any references to the various aluminum alloys are consistent with the designations used throughout the aluminum and container manufacturing industry.

Referring now to the following tables, figures and photographs, a novel recycled aluminum alloy is provided for use in a metallic slug used in an impact extrusion process to manufacture shaped metal containers and other apparatus. In certain instances, details that are not necessary for an understanding of the invention or that render other details difficult to perceive may have been omitted from these drawings, photographs and charts. It should be understood, of course, that the invention is not limited to the particular embodiments illustrated in the drawings.

In many of the charts and examples provided below, the term "ReAl", or "RE", etc. may be used to identify a particular alloy. Thus, the term "ReAl" or "RE" is merely an identifier for a metal containing recycled aluminum. In some instances, 3104 aluminum alloy commonly known in the art is recycled with another material, typically 1070 aluminum alloy. The number and percentage used after "ReAl" identifies the percent of that 3104 recycled alloy which is combined with a 1070 aluminum alloy to form the new alloy used in an impact extrusion process. For example, ReAl 3104 30% or RE 3104-30 identifies that 30% of a 3104 alloy has been combined with 70% of a relatively pure 1070 aluminum alloy to form a new alloy having the metallurgical composition of Si, Fe, Cu, etc. provided in the charts. Other charts refer to the number "3105" and a percentage of that alloy provided in a given alloy, such as 20% or 40%. Similar to the 3104 alloy, the term "3105" is an aluminum alloy well known by those skilled in the art, and the 20% or 40% reflects the amount of that alloy which is mixed with a relatively pure 1070 aluminum alloy to form the new alloy which is used in the metal slug and the impact extrusion process to manufacture a container such as an aerosol can. Although not provided in the chart below, it is also feasible to use 3004 scrap material or non scrap 3004 aluminum ingots in the process to create new alloys. Table 1 below identifies one example of the various compositions of the alloys discussed herein. All values listed in the table are approximate values.

TABLE 1

| Element | AA3104 | AA3004 | AA3105 | AA1070 |
|---|---|---|---|---|
| Si | 0.3 | 0.3 | 0.6 | 0.05 |
| Fe | 0.5 | 0.6 | 0.7 | 0.18 |
| Cu | 0.2 | 0.3 | 0.3 | 0.01 |
| Mn | 1.0 | 0.3 | 0.3 | 0.01 |
| Mg | 1.2 | 0.4 | 0.2 | 0.01 |
| Zn | 0.1 | 0.2 | 0.4 | 0.01 |
| Cr | 0.03 | 0.1 | 0.2 | 0.01 |
| Ti | 0.01 | 0.01 | 0.01 | 0.01 |
| Al | 96.7 | 97.8 | 97.3 | 99.7 |

Table 2 illustrates compositions of recycled slug materials, wherein the pure aluminum is aluminum alloy 1070 and the recycled scrap material is 3104 at different percentages. All values listed in the table are approximate values.

TABLE 2

| Element | 3104 20% | 3104 30% | 3104 40% | 3104 50% | 3104 60% |
|---|---|---|---|---|---|
| Si | 0.1 | 0.13 | 0.15 | 0.18 | 0.2 |
| Fe | 0.25 | 0.28 | 0.31 | 0.34 | 0.38 |
| Cu | 0.05 | 0.07 | 0.09 | 0.11 | 0.13 |
| Mn | 0.21 | 0.31 | 0.41 | 0.51 | 0.61 |
| Mg | 0.25 | 0.37 | 0.49 | 0.61 | 0.73 |
| Zn | 0.03 | 0.04 | 0.05 | 0.06 | 0.07 |
| Cr | 0.02 | 0.02 | 0.02 | 0.02 | 0.03 |
| Ti | 0.01 | 0.01 | 0.01 | 0.01 | 0.01 |
| Al | 99.08 | 98.77 | 98.47 | 98.16 | 97.84 |

Table 3 illustrates compositions of recycled slug materials, wherein the pure aluminum is aluminum alloy 1070 and the recycled scrap material is 3105 at different percentages. All values listed in the table are approximate values.

TABLE 3

| Element | 3105 20% | 3105 30% | 3105 40% | 3105 50% | 3105 60% |
|---|---|---|---|---|---|
| Si | 0.16 | 0.22 | 0.27 | 0.33 | 0.38 |
| Fe | 0.29 | 0.34 | 0.39 | 0.44 | 0.5 |
| Cu | 0.07 | 0.10 | 0.13 | 0.16 | 0.19 |
| Mn | 0.07 | 0.10 | 0.13 | 0.16 | 0.19 |
| Mg | 0.05 | 0.07 | 0.09 | 0.11 | 0.13 |
| Zn | 0.09 | 0.13 | 0.17 | 0.21 | 0.25 |
| Cr | 0.05 | 0.07 | 0.09 | 0.11 | 0.13 |
| Ti | 0.01 | 0.01 | 0.01 | 0.01 | 0.01 |
| Al | 99.21 | 98.96 | 98.72 | 98.47 | 98.22 |

Table 4 illustrates compositions of recycled slug materials, wherein the pure aluminum is aluminum alloy 1070 and the recycled scrap material is 3004 at different percentages. All values listed in the table are approximate values.

TABLE 4

| Element | 3004 20% | 3004 30% | 3004 40% | 3004 50% | 3004 60% |
|---|---|---|---|---|---|
| Si | 0.10 | 0.13 | 0.15 | 0.18 | 0.2 |
| Fe | 0.27 | 0.31 | 0.35 | 0.39 | 0.44 |
| Cu | 0.07 | 0.10 | 0.13 | 0.16 | 0.19 |
| Mn | 0.07 | 0.10 | 0.13 | 0.16 | 0.19 |
| Mg | 0.09 | 0.13 | 0.17 | 0.21 | 0.25 |
| Zn | 0.05 | 0.07 | 0.09 | 0.11 | 0.13 |

TABLE 4-continued

| Element | 3004 20% | 3004 30% | 3004 40% | 3004 50% | 3004 60% |
|---|---|---|---|---|---|
| Cr | 0.03 | 0.04 | 0.05 | 0.06 | 0.07 |
| Ti | 0.01 | 0.01 | 0.01 | 0.01 | 0.01 |
| Al | 99.31 | 99.11 | 98.92 | 98.72 | 98.52 |

FIG. 1 illustrates a method to fabricate an alloy from recycled aluminum 100. The recycled aluminum is processed to make slugs, which may be used in an impact extrusion process. Following the formation of the slugs, the slugs are processed in order to manufacture a container as provided in FIG. 2, which is discussed in greater detail below.

One aspect of the present invention is a method to fabricate a recycled aluminum material. The recycled aluminum slug material may comprise a recycled scrap aluminum and a pure aluminum, which are melted and cast together to form a novel recycled aluminum slug. Suitable recycled aluminum material may include many 3XXX alloys, especially 3005, 3104, 3105, 3103, 3013, and 3003. In smaller quantities, other alloys may be used to achieve the target chemistry. Alloy 3104 scrap is commonly sourced from beverage can plants. Alloy 3005 is commonly sourced from the automotive industry. The pure aluminum may include aluminum alloy 1070 or 1050. A variety of scrap aluminum sources may be used as a source for the alloying element of the ReAl.

Pure aluminum alloys such as 1050 or 1070 may be used with elemental additions to achieve the target ReAl chemical composition.

Melting

Scraps bricks comprising recycled scrap aluminum is melted to facilitate mixing with the molten pure aluminum 102. The recycled scrap aluminum may comprise aluminum alloy 3005, 3104, 3105, 3003, 3013 or 3103. When the furnace flame directly contacts the recycled aluminum, a small amount of the surface aluminum oxidizes. If the surface area is large, such as compacted scrap bricks, the amount of the material oxidized and the melt loss is higher than if the scrap bricks comprise a small surface area. Therefore, melting furnaces that utilize indirect methods to heat the materials are preferred to those that utilize direct flame impingement.

More specifically, melting may occur in several types of furnaces. For example, a reverbatory furnace 112 may be used which is typical to produce conventional impact extrusion slugs. The aluminum is subject to direct flame impingement. When melting compacted bricks of thin aluminum, the melt loss may likely be high. Therefore, a reverbatory furnace 112 is not a preferred method to produce ReAl slugs because of the high melt loss.

In general, a furnace that utilizes an indirect method to heat the materials is preferred. Furnaces that utilize an indirect method to heat materials include, but are not limited to, side well furnaces and rotary furnaces. Thus, a side well furnace 110 may be used as the furnace. Side well furnaces contain the aluminum and gas burners transfer heat to the molten metal. The molten metal is then used to melt the scrap. Side well furnaces also have an impeller that circulates the molten bath through a side well. Scrap aluminum is fed into the side well at a rate such that the material largely melts before it circulates into the portion of the side well furnace where direct flame impingement is possible. The use of a side well furnace 110 is a preferred method for melting scrap metal for ReAl production.

Alternatively, a rotary furnace 104 may be used. A rotary furnace 104 is similar to a concrete mixer. The aluminum scrap tumbles in one corner of the rotating cylinder. The flame is directed away from this area and heats the refractory lining. The hot lining rotates and contacts the aluminum and transfers energy to the aluminum. A rotary furnace 104 is a preferred method for melting scrap for ReAl production. If a rotary furnace 104 or side well furnace 110 is used, the scrap exiting the rotary furnace 104 or side well furnace 110 may be melted and cast into ingots, sows or pigs 106 in an operation separated from the slug production. These ingots, sows or pigs may be melted in a second reverbatory furnace 108 with minimal melt loss because the surface area is relatively small.

If elevated melt loss does occur during the melting process, dross must be removed from the bath.

In one embodiment, Titanium boride (TiBor) 114 is added to the melted blend of aluminum alloys just prior to the caster normally by a continuous feed of aluminum with a titanium boride dispersion. Alternatively, the TiBor could possibly be added to the aluminum scrap alloy while it is in the furnace. The TiBor may refine the grain structure of the ReAl during processing. The TiBor concentration is between about 0.5 kg/metric tonne to about 1.3 kg/metric tonne. In some embodiments, the TiBor concentration is about 0.6 kg/metric tonne.

Casting

Following the melting process, the molten alloy is cast. In the casting process, molten alloy is solidified into a continuous slab of any suitable dimension using one of several casting techniques. In some embodiments of the present invention, the cast slabs are about 8-14 inches in width and about 0.75-1.5 inches thick. The casting speed should be in the range of between about 0.5 to about 0.8 metric tonnes/hour/inch of width. In some embodiments, the casting speed may be about 0.62 metric tonnes/hour/inch of width.

Different casting methods may be used and may be chosen from a wheel belt caster 118, a Hazelett caster 116, a twin roll caster 120 and/or a block caster 122. When a wheel belt caster 118 is used, the molten aluminum is held between a flanged wheel and a thick metal belt during solidification. The belt wraps around the wheel at about 180°. Both the wheel and the belt are chilled with water on the back side to optimize and control heat extraction. This wheel belt caster process is commonly used to make 1070 and 1050 slugs. However, the thick steel belt is inflexible and unable to deflect and maintain contact with the slab that is shrinking due to solidification. The effect is magnified by the ReAl alloys because it solidifies over a larger temperature range than the more pure alloys, 1050 and 1070.

Alternatively, a Hazelett caster 116 may be used. When a Hazelett caster 116 is used, the molten aluminum is held between two flexible steel belts during solidification. Steel dam block are chain mounted and form the sides of the mold. The parallel belts slope slightly downward to allow gravity to feed molten aluminum into the system. High pressure water is sprayed on the back side of both belts to optimize and control heat extraction. This high pressure water also deflects the belt to keep it in contact with the solidifying, contracting slab. This belt deflection enables the Hazelett caster 116 to produce a wide range of aluminum (and other) alloys. The Hazelett caster process is commonly used to produce architectural aluminum strip and may be used to produce impact extrusion slugs.

Alternatively, a twin roll caster 120 may be used. When a twin roll caster 120 is used, the molten aluminum is held between two counter rotating, water cooled rolls during solidification. The process provides a very small solidification zone and is therefore limited to relatively thin "slabs". At this thickness, the term strip is probably more accurate than slab. This process is commonly used in the manufacture of aluminum foil.

Alternatively, a block caster 122 may be used. When a block caster 122 is used, the molten aluminum is held between a series of chain mounted steel blocks during solidification and form the sides of the mold. The blocks are water cooled to optimize and control heat extraction.

A lubricating powder may be applied to the caster components that contact the slab. More specifically, a graphite or silica powder may be applied as necessary. Temperature control is important during and following the casting process. During casting, regardless of the casting process used, the cooling rate and temperature profile of the slab must be carefully controlled during solidification. The wheel belt caster 118 reduces the cooling water flow rate to achieve this. If the Hazelett caster 116 is used, the water flow for general control and gas flow over the slab may be used to closely modify the temperature. Ambient conditions, especially air flow must be controlled near the caster. This air flow control is especially critical when gas flow is used to modify the slab temperature.

The temperature of the slab at the exit of the caster must also be carefully controlled. The exit temperature of the slab through the caster 116 must be above about 520° C., however the maximum temperature of any part of the slab exiting the caster must be less than about 582° C.

Rolling

Following casting, the thickness of the slab is reduced from about 28-35 mm to a specified thickness of between about 3 mm to about 14 mm with a hot mill and a cold mill 124/126. The relative thickness reduction taken in the hot mill 124/126 and the cold mill 130/132 significantly affects the metallurgical grain structure of the finished product. The thickness of the slab at the hot mill exit may vary. In some embodiments, the thickness of the slab following hot milling 124/126 is between about 6 mm to about 18 mm. In order to reach the specified thickness, the slab passes between two counter rotating rolls with a gap less than the incoming thickness while the slab is still at a high temperature of between about 450° C. to about 550° C. Rolling mills have two commonly used configurations. The most common is a two-high mill that contains only two counter-rotating rolls that contact the slab/strip. Two rolling mills are used to obtain the desired thickness. However, a different number of rolling mills may be used: 1,3, etc. Optionally, an advanced design is a four-high mill in which the two-counter rotating rolls, the work rolls, are backed up by larger rolls. Optionally, an additional hot mill 126 may be used. Alternatively, multiple hot mills may be used and the slabs may be recirculated to a hot mill 124/126 in order to achieve the specified thickness.

During hot rolling 124/126, the alloy material may dynamically recrystallize and/or recover. This recrystallization and/or recovery is a self annealing process enabled by the heat in the slab/strip. The temperatures at which dynamic recrystallization and/or recovery may occur varies with alloy content and may therefore differ for 1050/1070 and ReAl alloys. In most instances, the temperature for dynamic recrystallization and/or recovery is between about 350° C. to about 550° C. for ReAl material.

Following hot mill 124/126, the hot rolled strip is immersed in a quench tank 128. The quench tank 128 contains water that reduces the strip temperature to near ambient. Following quenching, the strip is subjected to a cold mill 130/132. The strip may be at ambient temperature and passes between two counter rotating rolls with a gap less than the incoming thickness. Normally two rolling mills may be used to obtain the desired thickness. However, a different number of rolling mills may be used: 1,3, etc. At ambient temperature, the cold rolled strip does not recrystallize. This cold working causes the yield strength of the material to increase and the ductility decreases. Cold mills 130/132 may have two-high and four-high configurations. The four-high configuration may have better thickness control and is therefore strongly preferred during cold rolling when the final thickness is made. Optionally, an additional cold mill 132 may be used. Alternatively, multiple cold mills may be used and the slabs may be recirculated to a cold mill 130/132 in order to achieve the specified thickness.

The relative amounts of thickness reduction taken during the hot mill 124/126 and cold mill 130/132 have a large effect on the recovery and recrystallization kinetics during annealing. The optimal ratio varies with alloy content, rolling mill capability and final strip thickness.

The internal friction in the strip causes the temperature to rise during cold milling 130/132 making the strip warm. Therefore, strips may be subjected to ambient cooling 134 at between about 15 to about 50° C., preferably about 25° C., for between about 4 hours to about 8 hours following cold milling 130/132. Alternatively, the cooled strip is typically held in storage to allow it to return to ambient temperature.

The cooled strips are punched 136. The cooled strip is uncoiled and fed into a die set mounted in a press. The die set cuts circular slugs from the strip, though it is understood that any shape of slug such as triangle, oval, circle, square, diamond, rectangle, pentagon, or the like may be used depending upon the shape of the die and/or the desired end product. The punching tool may be modified in order to control burrs. By way of example, the tool may be modified so that the die button chamfer is between about 0.039 inches by about 25° to about 0.050 inches by 29°.

Annealing

Optionally, the punched slugs are heated to recrystallize the grains and ideally form a homogeneous, equiaxed grain structure. The process decreases the strength of the material and increases ductility. Annealing may occur by batch annealing 138 and/or continuous annealing 140.

When the punched slugs are batch annealed 138, the punched slugs may be loosely loaded into a holding device such as a wire mesh baskets. Several holding devices may be stacked together inside a furnace. The door to the furnace is closed and the slugs may be heated to a target temperature and held for a specified time. The target temperature of the furnace is preferably between about 470° C. to about 600° C. for between about 5 to about 9 hours, though the annealing time and temperature have a strong interaction and are influenced by the alloy content of the slugs. The furnace may be turned off and the slugs allowed to slowly cool in the furnace. Because of the large mass of punched slugs in the furnace, there may be considerable inconsistency in the temperature of the slugs. The packed slugs on the outside of the pack reach a higher temperature faster. The central slugs heat more slowly and never reach the maximum temperature achieved by the peripheral slugs. Furthermore, air drying the slugs may allow for the formation of oxides. In order to prevent or decrease the formation of oxides, an inert gas may be circulated in the furnace while the furnace is at temperature and/or while it is cooled. Alternatively, the batch annealing 138 may occur in an inert atmosphere or under vacuum.

Figure 3:
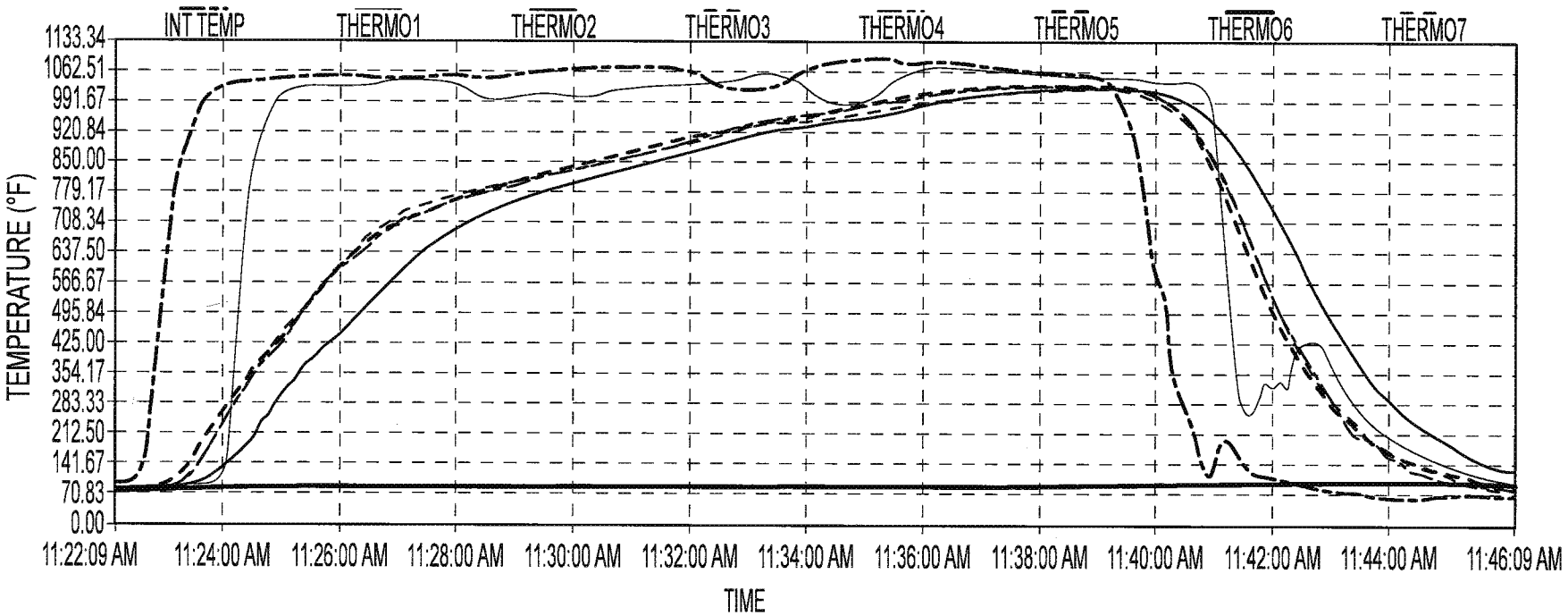
FIG. 3 illustrates a continuous anneal process.

Alternatively, the punched slugs may be continuously annealed 140. When the punched slugs are continuous annealed 140, the slugs are loosely distributed on a metal mesh belt on conveyed through a multi-zone furnace. The punched slugs are quickly heated to a peak metal temperature and then quickly cooled. The operation may be performed in air. The peak metal temperature is between about 450° C. to about 570° C. The peak metal temperature influences the final metallurgical characteristics. The peak temperature for optimal metallurgical characteristics is influenced by alloy content. Continuous annealing 140 is the preferred process for producing ReAl slugs. Continuous annealing 140 provides two benefits over batch annealing. First, the shorter time at elevated temperature reduces oxide formation on the surface of the slug. Aluminum oxides are a concern, however, magnesium oxides are a major concern due to its extreme abrasive nature. Increased magnesium oxide on the surface of the punched slugs may cause excessive scratching during the impact extrusion process. On extended runs these scratches are an unacceptable quality defect. Second, the precisely controlled and homogeneous thermal cycle including rapid heating, limited time at elevated temperature and rapid cooling of the continuous anneal 140 results in improved and more uniform metallurgical grain structure. This in turn produces impact extruded containers of higher strength. Higher strength enables additional lightweight potential in the impact extruded containers. FIG. 3 illustrates temperature curves of a continuous annealing process.

Finishing

Optionally, the surface of the punched slugs may be finished by roughening the surface of the punched slugs. Different methods may be used to finish the punched slugs. In an embodiment, a tumbler process 142 may be used. A large quantity of the punched slugs are placed in a drum or other container and the drum is rotated and or vibrated. As slugs fall onto other slugs, denting may occur to one or both slugs. The purpose of roughening the surface is to increase the high surface area of the punched slug and create recesses to hold lubricant. The large faces of the punched slugs may also be finished along with the sheared surfaces.

In another embodiment, a shot blast finishing process 144 may be used. In the shot blast finishing process 144, a large number of slugs are placed in an enclosed drum and subjected to impingement by aluminum shot or other materials. The shot forms small depression on the surfaces of the slugs. The slugs are tumbled slightly so the aluminum shot contacts all surfaces of the slug.

Shot blasting 144 is the preferred process for producing ReAl slugs, and aggressive shot blasting has been shown to be the most effective at removing surface oxides from slugs. This removal of the surface oxides are especially critical for removing adherent magnesium oxides, which cause scratches in impact extruded containers if they are not removed from the slug.

Slug Processing

Figure 2:
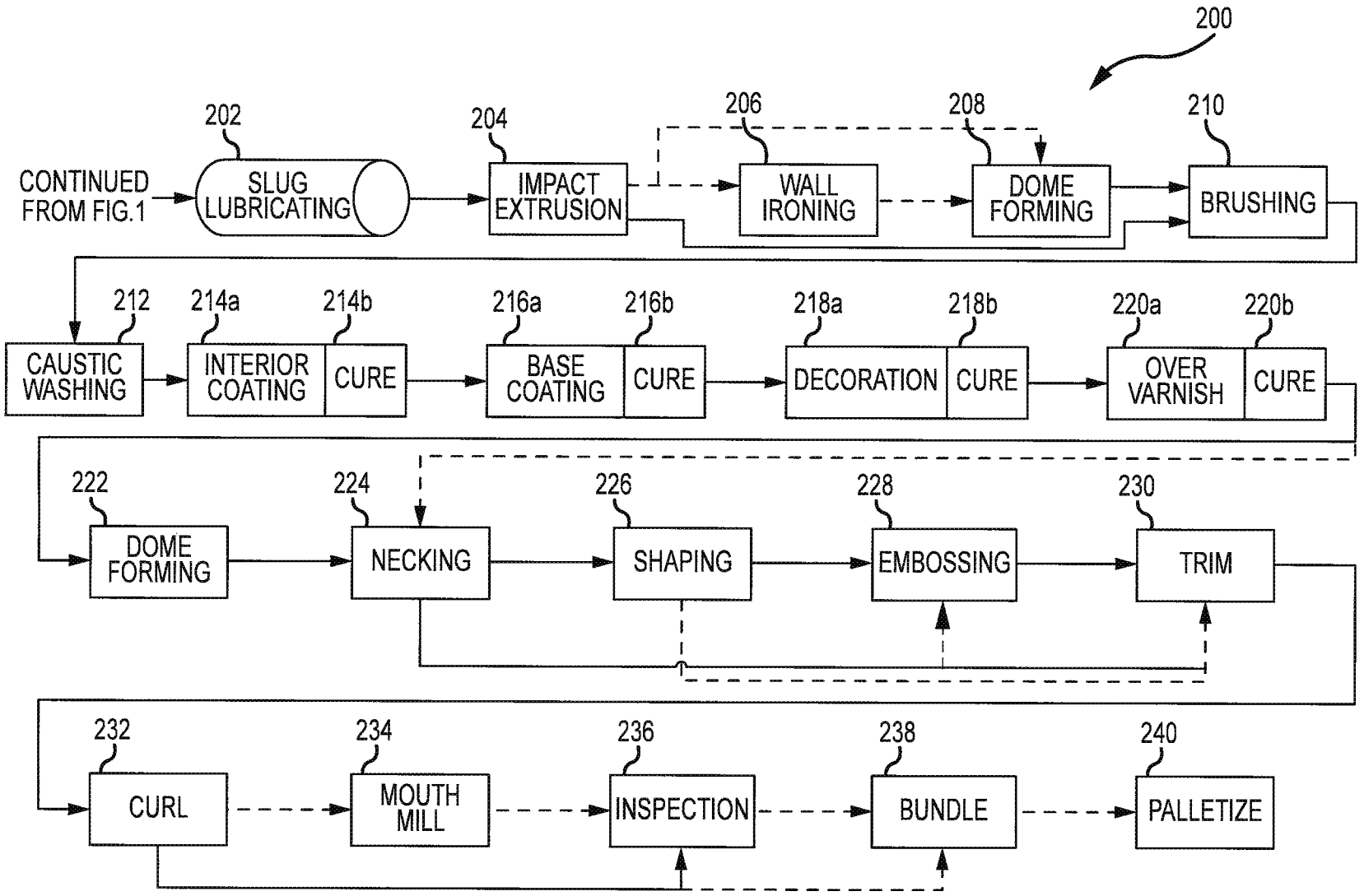
FIG. 2 illustrates an impact extrusion method for use with the recycled aluminum material.

FIG. 2 illustrates a method to manufacture a metallic container 200 using a slug manufactured from recycled scrap material as illustrated in FIG. 1.

A slug lubrication process 202 may be used wherein the slugs are tumbled with a powdered lubricant. Any suitable lubricant may be used, such as Sapilub GR8. Typically about 100 g of lubricant is used per about 100 kg of slugs. Tumbling the lubricant with the slugs forces lubricant onto the slugs. If the slugs have been roughened, then tumbling the slugs with the lubricants force the lubricant into the depressions created during the finishing operation.

Following the slug lubrication process 202, the lubricated slugs are subjected to an impact extrusion process 204. More specifically, the lubricated slugs are placed in a cemented carbide die of precise shape. The lubricated slug is impacted by a steel punch, also of precise shape, and the aluminum is extruded backwards away from the die. The tooling shapes dictate the wall thickness of the extruded tube portion of the container. Although this process is generally known as back extrusion, a forward extrusion process or combinations of back and forward extrusion could also be used as appreciated by one skilled in the art.

Optionally, wall ironing 206 may be performed. The container may be passed between a punch and an ironing die with negative clearance. Wall ironing 206 thins the wall of the tube. The higher strength of ReAl alloy increases die deflection. Therefore a smaller die is required to achieve the desired wall thickness. This optional process optimizes material distribution and keeps longer tubes straight.

Optionally, following the impact extrusion 204 or the wall ironing 206, the dome forming 208 on the bottom of the container may be performed. The full dome or a portion of the dome may be formed either at the end of the ironing stroke or in the trimmer.

After dome forming, the container is brushed 210 to remove surface imperfections. The rotating container is brushed by an oscillating metal or plastic, typically nylon, brush. Furthermore, brushing 210 may be performed if the container has been subjected to wall ironing 206 and/or doming 208.

Following brushing 210, the container is washed 212 in a caustic solution to remove lubricants and other debris. The caustic wash 212 may comprise sodium hydroxide or alternatively potassium hydroxide or other similar chemicals known by those skilled in the art.

Coatings

The interior of the container is typically lance coated 214*a*. In one embodiment, the coating may be epoxy based. The coating may be applied using any suitable method including, but not limited to, spraying, painting, brushing, dipping, or the like. The coating is thermally cured at a temperature of between about 200 to about 250° C. for between about 5 to about 15 minutes.

Base coating 216*a* is generally applied to the exterior of the container. The base coating may be a white or clear base coat. The coating may be applied using any suitable method including, but not limited to, spraying, painting, brushing, dipping, or the like. The coating is thermally cured 216*b* at a temperature of between about 110 to about 180° C. for between about 5 to about 15 minutes.

Decorative inks 218*a* may also be applied to the base coated container. The decorative ink may be applied using any suitable method including, but not limited to, spraying, painting, brushing, dipping, printing or the like. The decorative inks are thermally cured at a temperature of between about 120 to about 180° C. for between about 5 to about 15 minutes.

Clear over varnish 220*a* is applied to the tube. The varnish may be applied using any suitable method including, but not limited to, spraying, painting, brushing, dipping, or the like. The varnish is thermally cured 220*b* at a temperature of between about 150 to about 200° C. for between about 5 to about 15 minutes.

Dome Forming

Optionally, dome forming 222 may be formed or completed on the bottom of the container. Dome forming 222 may be completed at this stage to ensure that the decoration extends to the standing surface of the container. An advantage of a two stage doming operation (before trimming 230 and before necking 224) is that the base coat extends to the standing surface of the finished can. However, this method may result in a higher rate of cracking of the internal coating. By decreasing the final dome depth before necking, this issue may be resolved.

Necking and Shaping

In a number of successive operations, the opening diameter of the container may be reduced by a process called necking 224. The number of reducing steps depends on the diameter reduction of the container and the shape of the neck. For ReAl alloy material, more necking steps are generally anticipated. Further, as the alloy content is altered, some modifications may be expected. For example, one modification requires that the necking center guides be changed in some instances. Larger center guides must be installed when running lightweight ReAl containers that are thinner near the top.

Optionally, the body of the container may be shaped 226. Shaping 228 may occur in various stages. The ReAl alloy may require additional shaping stages as compared to a traditional impact extrusion process. Similar to necking, smaller steps must be used when shaping ReAl containers.

Embossing

Optionally, tooling may move perpendicular to the container axis and emboss shapes in the container 228. The force applied during embossing 228 may be higher when using ReAl material than when traditional impact extrusion material is used as a result of higher as formed strength relative to 1070 or 1050 alloys.

Trimming and Curling

Metal flow in necking 224 may create an uneven, work hardened edge. Therefore, the edge is trimmed 230 prior to curling. Due to anisotropy differences, ReAl thickens in a different profile during necking 224. Therefore, it is possible at high necking reductions and high alloy content that additional trimming operations may be required.

The open edge of the container is curled 232 over itself to create a mounting surface for an aerosol valve. For beverage bottles, the curl may accept a crown closure. Optionally, a small amount of material may be machined off of the top of the curl, which is known as the mouth mill 234. The mouth mill 234 may be required for mounting certain aerosol valves.

Inspections and Packaging

Inspections 235 may optionally be performed on the containers. Inspection steps may include camera testing, pressure testing, or other suitable testing.

The containers may be packaged. Optionally, the containers may be bundled 238. When bundling 238, the containers may be arranged in groups. The group size may vary and in some embodiments, the group size is about 100 containers. The size of the group may depend upon the diameter of the containers. The groups may be bundled using plastic strapping or other similar known processes. A special consideration for ReAl containers is that the strap tension must be controlled in order to prevent heel denting in high contact pressure areas of the bundle.

In an alternative packaging method, the containers are bulk palletized 240 similar to beverage containers.

EXAMPLES

Figure 4:
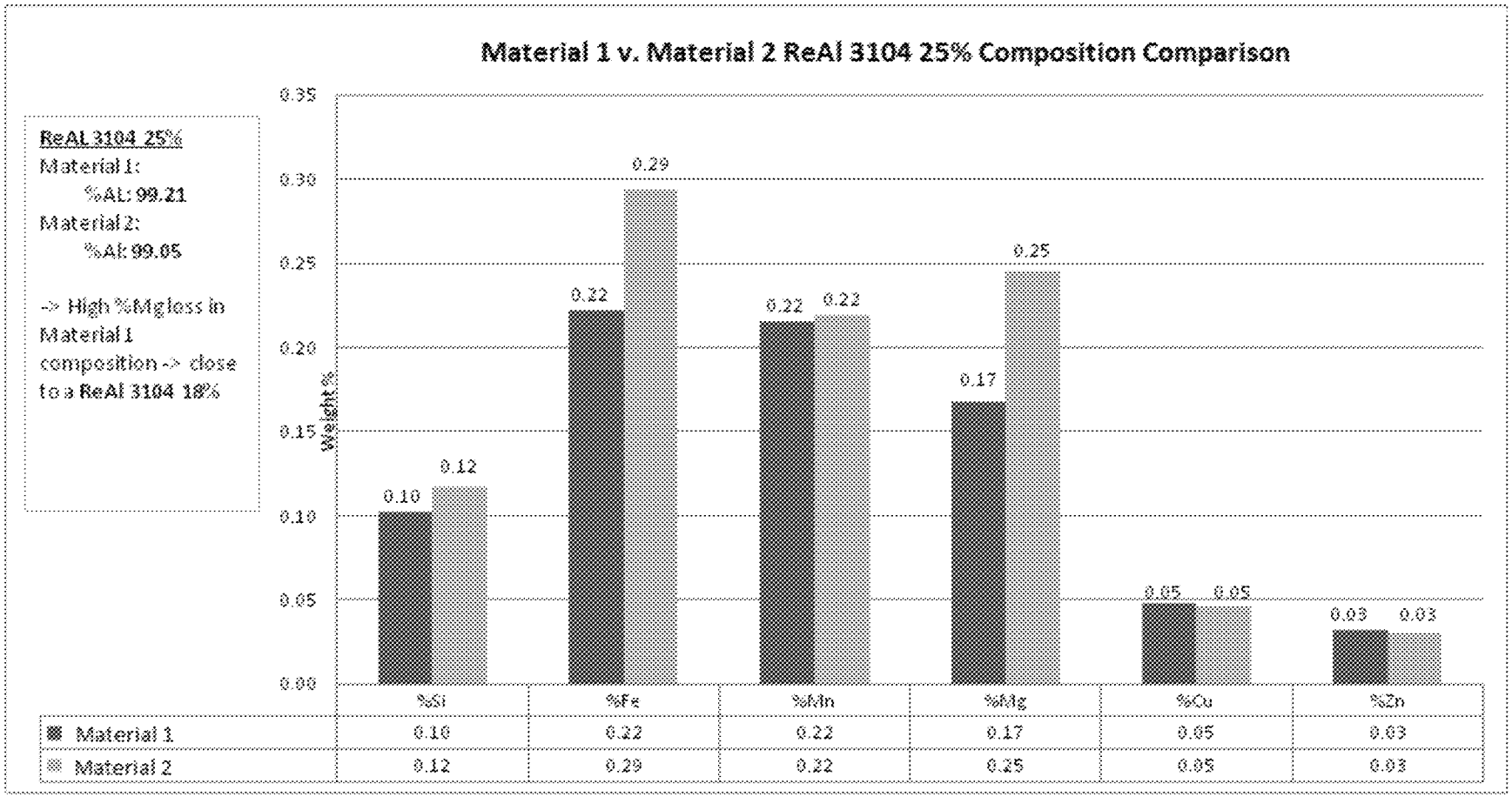
FIG. 4 illustrates a composition comparison of Material 1 and Material 2.

ReAl 3104 25% slugs were tested using two materials. Material 1 used remelt secondary ingots (RSI) produced from a briquetted cupper scrap. Material 1 samples were made at the Ball Advanced Aluminum Technology plant in Sherbrook Canada and Virginia. Material 2 melted briquette scrap. Material 2 samples were made at Copal, S.A.S. in France. FIG. 4 illustrates a comparison of Material 1 versus Material 2. Material 1 is much closer to 18% 3104 cupper scrap content due to a significant loss of magnesium compared to the flood composition of Material 2. The processing type to melt the briquetted 3104 cupper scrap may have an influence on the final chemical composition of ReAl material.

The finish treatment for Material 1 samples was shot blasted. The finish for Material 2 samples was tumbled.

Table 5 illustrates the slug hardness for reference material 1050, Material 1 and Material 2 after finishing.

TABLE 5

| Alloy | 1050 (reference) | Material 1 | Material 2 |
|---|---|---|---|
| Hardness (HB) | 21.5 | 29 | 30.7 |

Due to the finishing, the values given in Table 5 may be higher than those measured after annealing process. Material 1 had a hardness that was approximately 35% greater than the reference material 1050, while Material 2 had a hardness that was approximately 43% greater than 1050.

The lubricant used was Sapilub GR8. Table 6 illustrates the lubrication parameters and lubrication weight for 100 kg of slugs for a reference material 1050, Material 1 and Material 2. Note that the lubrication material for the reference material 1050 (GTTX) was different from the lubrication used for the slugs comprising Material 1 and Material 2 (GR8).

TABLE 6

| Lubrication parameters for 100 kg of slugs | 1050 (reference) | Material 1 | Material 2 |
|---|---|---|---|
| Lubricant weight (g) | 100 (GTTX) | 125 (GR8) | 110 (GR8) |
| Time of tumbler rotation (min) | 30 | 30 | 30 |

The lubrication process was performed on an offline tumbler for all slugs. The difference in lubricant ratio is due to the type of surface treatment (tumbled surface requires less lubricant than shot-blasted surface treatments).

The monobloc die used was a standard sintered carbide GJ15-1000HV. The punch head was a Bohler 5600-680HV. The shape of the die was conical.

Tubes were brushed to highlight potential visual score marks and scratches. The internal varnish on the containers was PPG HOBA 7940-301/B (Epoxy phenolic). The setting of the application of the internal varnish Epoxy-phenolic PPG 7940 was standard. Temperature and time of curing was about 250° C. during about 8 min 30 s. There were no issues of porosity at following the internal varnish.

White base coat with gloss was applied to the containers. A printed design was also added to the containers.

Example 1

Example 1 utilized Material 1 and Material 2 with slugs that had a diameter of about 44.65 mm and a height of about 5.5 mm. The mass of the slug material was about 23.25 g. The final dimension of the container following processing, but prior to trimming, was about 150 mm+/−about 10 mm in height by about 45.14 mm in diameter. The thickness of the final container was about 0.28 mm+/−0.03 mm. The final mass of the container was about 23.22 g. A standard necking tooling was used.

Material 1 slugs tend to perform better in general with no score mark nor scratches emergence neither outside nor inside the tubes. Material 2 slugs are more sensitive to scratches and are more abrasive to the punch head surface. After using Material 2 slugs, the punch head needed to be changed because it was worn. A larger punch may be required to meet the container parameters.

Example 2

Example 2 utilized Material 1 and Material 2 with slugs that had a diameter of about 44.65 mm and a height of about 5.0 mm. The mass of the slug material was about 21.14 g. The final dimensions of the container following processing, but prior to trimming was about was about 150 mm+/−about 10 mm in height by about 45.14 mm in diameter. The thickness of the final container was about 0.24 mm+/−0.03 mm. The final mass of the container was about 20.65 g. A larger diameter pilot was used. The diameter of the pilot was about 0.1 mm.

Figure 5:
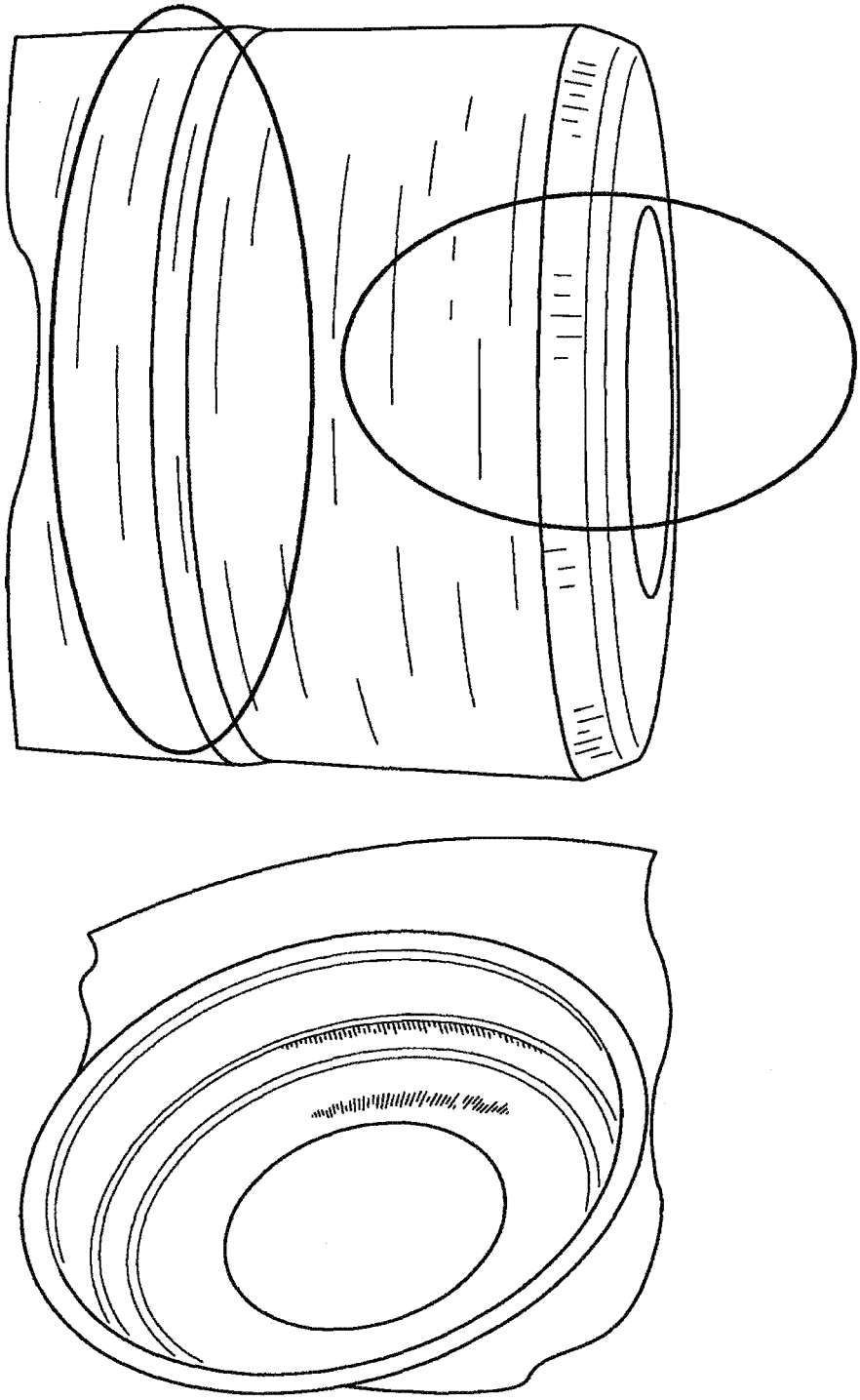
FIG. 5 illustrates a punch head and press die.

Almost no eccentricity in wall thicknesses (<about 0.02 mm) occurred due to the use of a brand new press die and a punch head. Once again, the slugs from Material 1 appear to perform better than Material 2 slugs. Indeed, similar than the results from Experiment 1, almost no scratch was visible neither inside nor outside the containers with Material 1. When Material 2 slugs were used, scratches appeared after 6-7 ku from time to time on the exterior of the container and mainly on the inside of the container. Additionally, the punch head was significantly worn. FIG. 5 illustrates a steel punch head and a sintered carbide press die. The punch head surface after pressing all Material 1 slugs was without any score mark on it. The press die in sintered carbide was greatly damaged throughout the perimeter. Press speed lines for both experiments were at about 175 cpm and both experiments rant without major stops.

Table 7 illustrates the extrusion force for samples made using the parameters discussed in Experiment 1 for Materials 1 and 2 and Experiment 2 for Material 1 and 2. A reference material of 1050 is also shown.

TABLE 7

| Alloy | 1050 (reference) | Material 1 | Material 2 |
|---|---|---|---|
| Example 1 Extrusion Force (kN) | 1050-1100 | 1090-1150 | 1100-1170 |
| Example 2 Extrusion Force (kN) | — | 1130-1200 | 1150-1300 |

There was no significant increase of extrusion power across the samples, regardless of the material or the starting dimensions of the slugs. The values are far below the safe limit for the final container size.

Table 8 illustrates the tube parameters for Materials 1 and 2 using the slug dimensions of Experiment 1 and the tube parameters for Materials 1 and 2 using the slug dimensions of Experiment 2.

TABLE 8

| Tube Parameters | Bottom Thickness (mm) | Bottom Wall Thickness (mm) | Top Wall Thickness (mm) | Trimmed length (mm) |
|---|---|---|---|---|
| Tolerance | 0.70-0.80 | 0.27-0.31 | 0.34-0.38 | min. 2 |
| 1050 (reference) | 0.75 | 0.285 | 0.35 | 4-6 |
| Material 1 Experiment 1 | 0.77 | 0.285 | 0.35 | 5-7 |
| Material 2 Experiment 1 | 0.73 | 0.29 | 0.35 | 4-6 |
| Material 1 Experiment 2 | 0.73 | 0.24 | 0.32 | 10-11 |
| Material 2 Experiment 2 | 0.68 | 0.245 | 0.325 | 9-10 |

As illustrated in Table 8, the bottom thickness was within the tolerance for each material except for Material 2, Experiment 2. The bottom wall thickness tolerance and the top wall thickness tolerance were not achieved for either Experiment 2 material.

Table 9 illustrates the bulging depth (mm) and the porosity in (mA), which is a measure of the integrity of the interior coating.

TABLE 9

| Alloy | 1050 (reference) | Material 1 | | Material 2 | |
|---|---|---|---|---|---|
| Experiment 1 | 8.2 mm/ 1.6 mA | 8 mm/16 mA | 7.6 mm/ 1 mA | 7.5 mm/2 mA | |
| Experiment 2 | — | 7.6 mm/0.8 mA | | 7.6 mm/ 14 mA | 7.3 mm/ 2.3 mA |

Tubes with the dimensions of Experiment 1 and Experiment 2 parameters were necked properly with both Material 1 and Material 2 slugs. New pilots were needed to run lightweight cans, the necking shape and all dimensional parameters remained within specification. The chimney thickness (about 0.45 to about 0.48 mm with white basecoat) before curling was sufficiently thick. Furthermore, the trim length at necking was satisfactory at about 2.4 mm.

Slugs made from both Material 1 and Material 2 created porosity after the bulging at the necking station. After decreasing bulge depth, the porosity level came back to normal. Furthermore, decreasing the bulging depth for a second time with Material 2 helped to resolve porosity issues.

Figure 6:
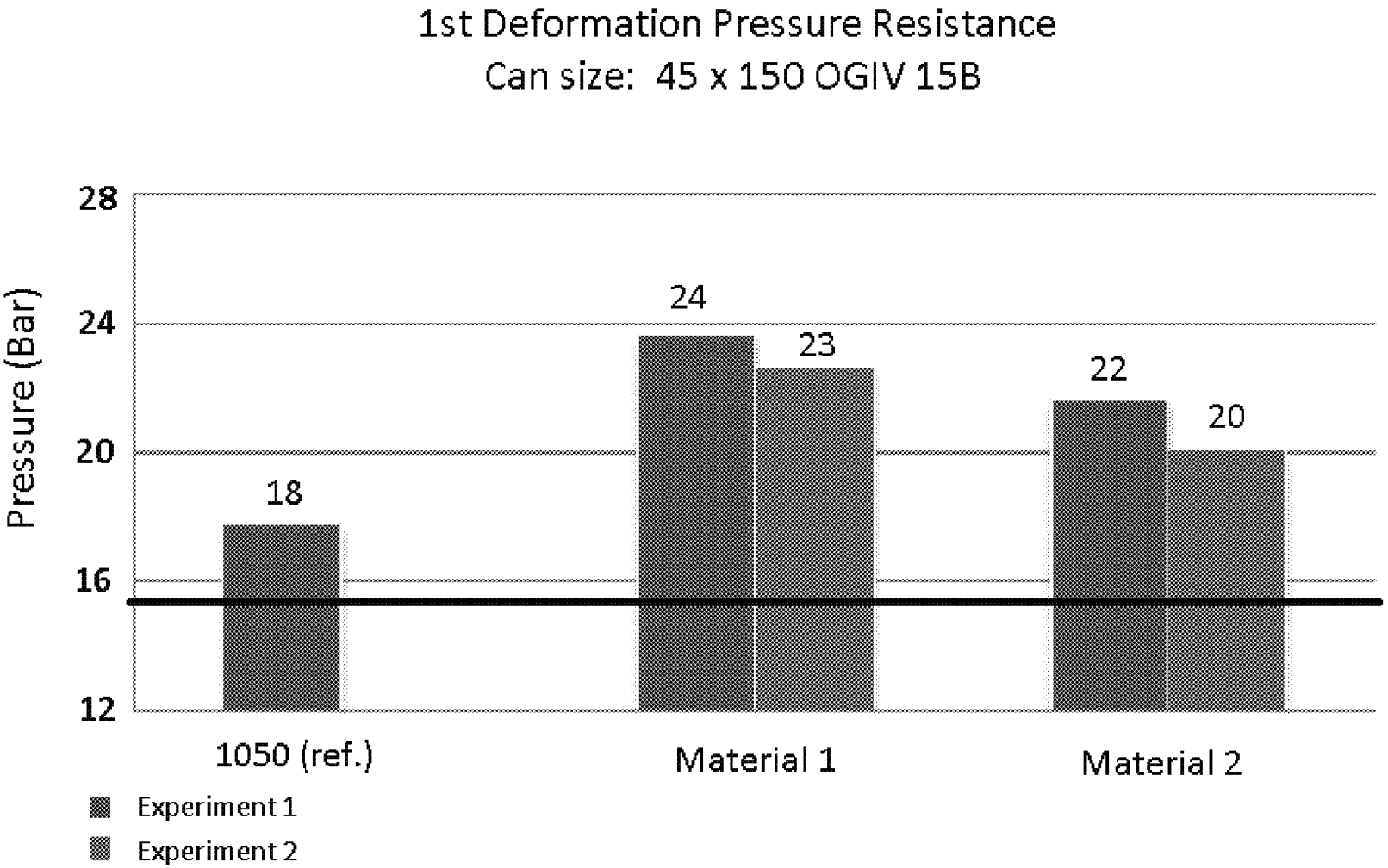
FIG. 6 illustrates deformation pressure resistance for containers made with Material 1 and Material 2.
Figure 7:
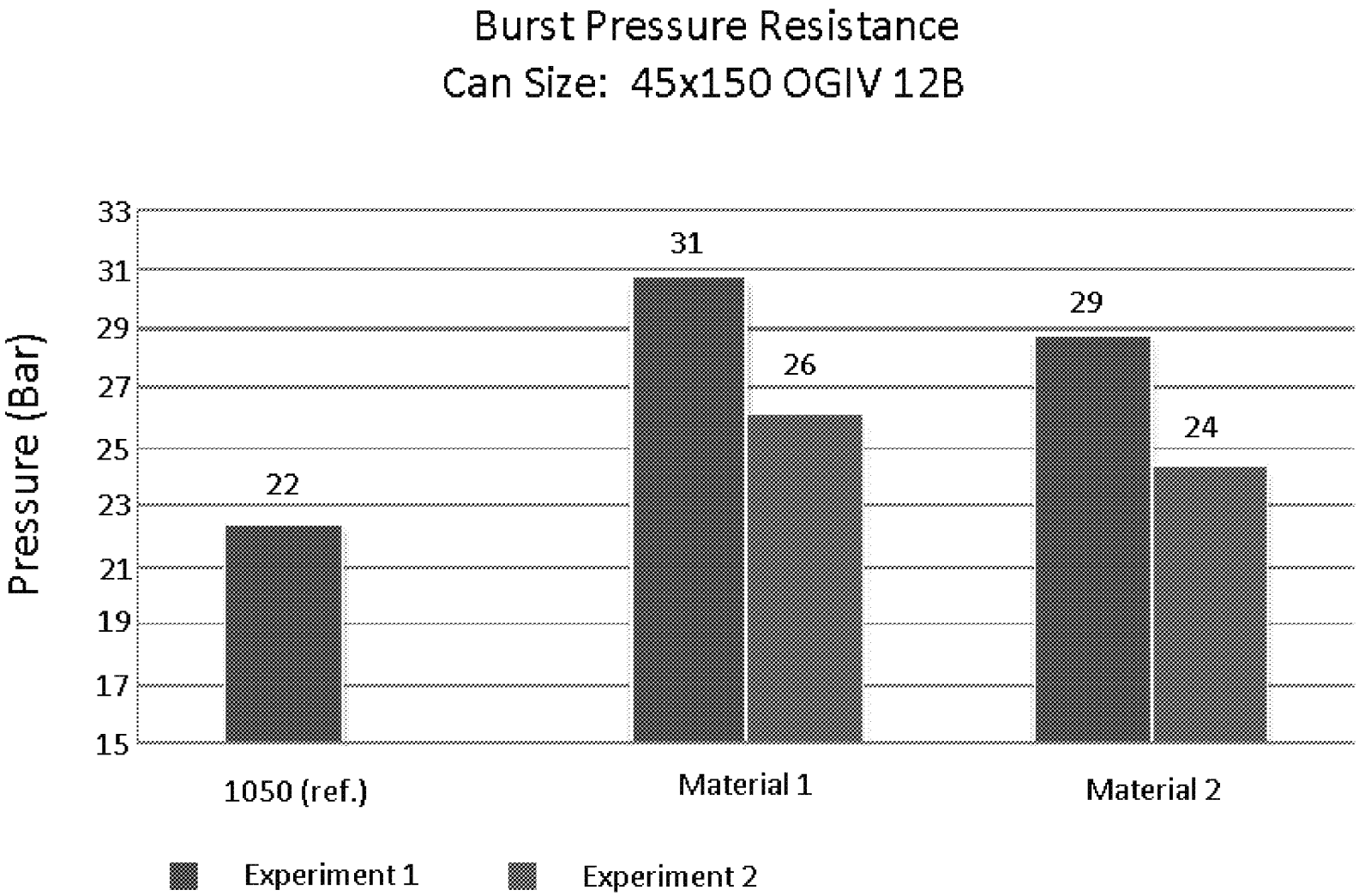
FIG. 7 illustrates burst pressure resistances for Material 1 and Material 2.
Figure 8:
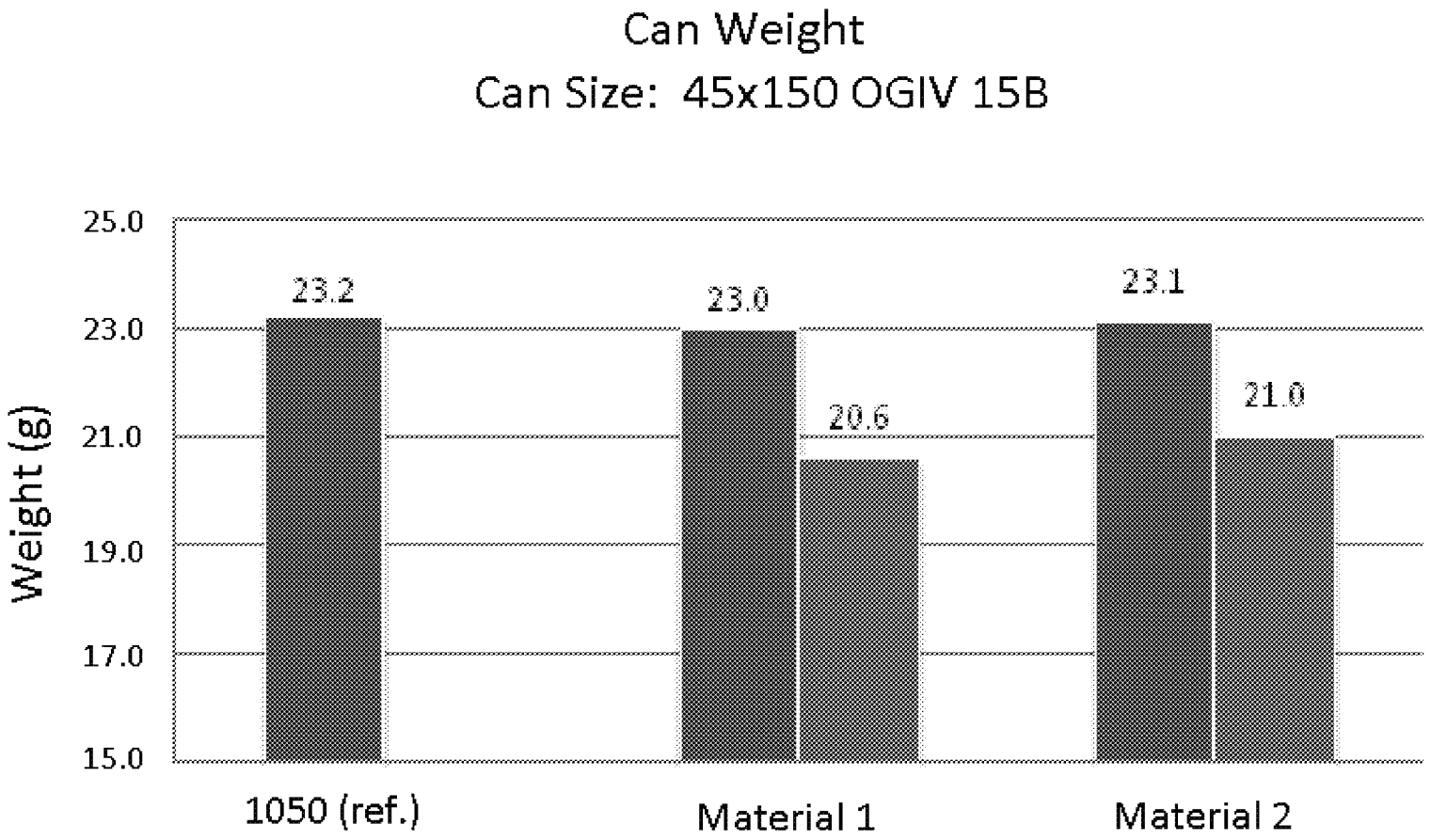
FIG. 8 illustrates container masses for sample Material 1 and sample Material 2.

Regarding pressure resistance, results are very impressive even for the lightweight cans. Surprisingly, Material 1 slugs have higher pressure resistance (about +2 bars) even if they have lower percentage of magnesium and percentage of iron than the Material 2 ones. Though the cause is unclear, it may be a consequence of the continuous annealing performed in Material 1 versus the batch annealing. FIG. 6 illustrates first deformation pressure resistance for cans, while FIG. 7 illustrates the burst pressure for cans. FIG. 8 illustrates the container masses and alloy compositions.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. An aluminum alloy slug, comprising:

a thickness of between about 3 millimeters (mm) and about 14 mm, wherein the aluminum alloy slug is adapted for use in an impact extrusion process to form a metallic container, wherein the aluminum alloy slug is formed of an aluminum alloy with a composition comprising:

at least 97.84 wt. % Al and no more than 99.31 wt. % Al;

at least 0.10 wt. % Si and no more than 0.18 wt. % Si;

at least 0.25 wt. % Fe and no more than 0.44 wt. % Fe;

at least 0.18 wt. % Mn and no more than 0.61 wt. % Mn;

at least 0.05 wt. % Mg and no more than 0.17 wt. % Mg;

at least 0.03 wt. % Zn and no more than 0.09 wt. % Zn;

at least 0.02 wt. % Cr and no more than 0.10 wt. % Cr;

about 0.01 wt. % Ti; and the balance in impurities, and wherein the aluminum alloy is formed by mixing between 20 and 60 wt. % of a recycled aluminum material with a prime aluminum material.

2. The aluminum alloy slug of claim 1, wherein the recycled aluminum material is a 3104 aluminum alloy and the prime aluminum material comprises at least one of a 1070 aluminum alloy and a 1050 aluminum alloy.

3. The aluminum alloy slug of claim 2, wherein the aluminum alloy comprises:

between about 0.10 and 0.16 wt. % of Mg;

between about 0.21 and 0.61 wt. % of Mn;

between about 0.25 and 0.37 wt. % of Fe; and between about 0.1 and 0.17 wt. % of Si.

4. The aluminum alloy slug of claim 1, wherein the recycled aluminum material is a 3105 aluminum alloy and the prime aluminum material comprises at least one of a 1070 aluminum alloy and a 1050 aluminum alloy.

5. The aluminum alloy slug of claim 4, wherein the aluminum alloy comprises:

between about 0.10 and 0.13 wt. % of Mg;

between about 0.21 and 0.61 wt. % of Mn;

between about 0.25 and 0.37 wt. % of Fe; and between about 0.10 and 0.0.17 wt. % of Si.

6. The aluminum alloy slug of claim 1, wherein the recycled aluminum material is a 3004 aluminum alloy and the prime aluminum material comprises at least one of a 1070 aluminum alloy and a 1050 aluminum alloy.

7. The aluminum alloy slug of claim 6, wherein the aluminum alloy comprises:

between about 0.09 and 0.16 wt. % of Mg;

between about 0.21 and 0.61 wt. % of Mn;

between about 0.25 and 0.37 wt. % of Fe; and between about 0.1 and 0.17 wt. % of Si.

8. The aluminum alloy slug of claim 1, wherein the aluminum alloy comprises 20 wt. % of the recycled aluminum material.

9. The aluminum alloy slug of claim 1, wherein the aluminum alloy comprises 30 wt. % of the recycled aluminum material.

10. The aluminum alloy slug of claim 1, wherein the aluminum alloy comprises 40 wt. % of the recycled aluminum material.

11. The aluminum alloy slug of claim 1, wherein the aluminum alloy comprises 50 wt. % of the recycled aluminum material.

12. The aluminum alloy slug of claim 1, wherein the aluminum alloy comprises 60 wt. % of the recycled aluminum material.

13. The aluminum alloy slug of claim 1, wherein the thickness of the aluminum alloy slug is at least about 5.5 mm.

14. The aluminum alloy slug of claim 1, wherein the thickness of the aluminum alloy slug is at least about 5.0 mm.

15. The aluminum alloy slug of claim 1, wherein the aluminum alloy slug is punched from a milled slab with a thickness of between about 3 mm and about 14 mm, wherein the milled slab is formed via cold rolling from a hot milled slab with a thickness of between about 6 mm and about 18 mm, wherein the hot milled slab is formed via hot rolling from a slab with a thickness of between about 28 mm and about 35 mm, and wherein the slab is cast from the recycled aluminum material and the prime aluminum material.

16. The aluminum alloy slug of claim 1, wherein the aluminum alloy comprises:

between 0.10 and 0.17 wt. % Si;

between 0.25 and 0.37 wt. % Fe;

between 0.21 and 0.61 wt. % Mn; and between 0.10 and 0.16 wt. % Mg.

17. The aluminum alloy slug of claim 1, wherein the aluminum alloy slug is annealed to a peak temperature of between about 450° C. to about 570° C.

18. The aluminum alloy slug of claim 17, wherein the aluminum alloy slug includes recesses on at least one surface to hold a lubricant.

19. The aluminum alloy slug of claim 18, wherein the aluminum alloy slug is coated with a lubricant.

20. The aluminum alloy slug of claim 17, wherein an exterior surface of the aluminum alloy slug is finished by contact with shot to remove adherent oxides.

* * * * *